US009260237B2

(12) United States Patent
Brace et al.

(10) Patent No.: US 9,260,237 B2
(45) Date of Patent: Feb. 16, 2016

(54) CAP FOR DISPENSING LIQUIDS OR GELS

(71) Applicant: Precision Valve Corporation, Rye Brook, NY (US)

(72) Inventors: Geoffrey Brace, Columbus, NC (US); John T. Kawalchuk, Jr., Greenville, SC (US); Michael Paul Downey, Greer, SC (US); Anthony John Kennedy, Sydney (AU); John Zeritis, Marrickville (AU)

(73) Assignee: Precision Valve Corporation, Rye Brook, NY (US)

( * ) Notice: Subject to any disclaimer, the term of this patent is extended or adjusted under 35 U.S.C. 154(b) by 0 days.

(21) Appl. No.: 14/132,507

(22) Filed: Dec. 18, 2013

(65) Prior Publication Data

US 2015/0166250 A1 Jun. 18, 2015

(51) Int. Cl.

| | |
|---|---|
| ***B65D 83/40*** | (2006.01) |
| ***B65D 43/02*** | (2006.01) |
| ***B65D 41/40*** | (2006.01) |
| ***B65D 43/26*** | (2006.01) |
| ***B65D 50/00*** | (2006.01) |
| ***B65D 83/22*** | (2006.01) |
| ***B65D 83/20*** | (2006.01) |

(52) U.S. Cl.

CPC ..... *B65D 83/40* (2013.01); *B65D 41/40* (2013.01); *B65D 43/0277* (2013.01); *B65D 43/26* (2013.01); *B65D 50/00* (2013.01); *B65D 83/205* (2013.01); *B65D 83/206* (2013.01); *B65D 83/226* (2013.01)

(58) Field of Classification Search

CPC .... B65D 83/205; B65D 83/206; B65D 83/22; B65D 83/224; B65D 83/226; B65D 2101/0023; B65D 83/40; B65D 41/40; B65D 43/0277; B65D 43/26; B65D 50/00

USPC ..... 222/402.13, 402.1, 402.11, 402.12, 222/182, 153.07, 153.1, 153.11, 153.13

See application file for complete search history.

(56) References Cited

U.S. PATENT DOCUMENTS

| | | | |
|---|---|---|---|
| 2,887,273 | A | 5/1959 | Anderson et al. |
| 3,185,350 | A | 5/1965 | Abplanalp et al. |

(Continued)

FOREIGN PATENT DOCUMENTS

| | | |
|---|---|---|
| EP | 2607266 | 6/2013 |
| FR | 2881721 | 8/2006 |

(Continued)

OTHER PUBLICATIONS

International Search Report dated Apr. 30, 2014 corresponding to International Application No. PCT/US2013/076186; 3 pages.

(Continued)

*Primary Examiner* — Nicholas J Weiss

(74) *Attorney, Agent, or Firm* — Ohlandt, Greeley, Ruggiero & Perle, L.L.P.

(57) ABSTRACT

A cap for a container that stores and dispenses fluids or gels that includes a shroud having a shroud wall surrounding an opening and a collar connected on the shroud so that the collar selectively rotates relative to the shroud, is provided. The collar is rotatable between a closed position and an open position. The actuator is connected to the shroud, and has a contact portion. The contact portion is in the opening of the shroud. The actuator is movable in the closed position and the open position by a force that is applied to the contact portion only after removal of a tab.

23 Claims, 46 Drawing Sheets

(56) References Cited

U.S. PATENT DOCUMENTS

| | | | | | |
|---|---|---|---|---|---|
| 3,373,908 | A | | 3/1968 | Crowell | |
| 3,460,719 | A | | 8/1969 | O'Donnell et al. | |
| 3,474,939 | A | | 10/1969 | O'Donnell et al. | |
| 3,698,604 | A | | 10/1972 | Nigro | |
| 3,729,119 | A | | 4/1973 | Sette et al. | |
| 3,734,354 | A | * | 5/1973 | Gach | 222/153.11 |
| 3,744,682 | A | | 7/1973 | Blank | |
| 3,754,689 | A | | 8/1973 | Blank | |
| 3,779,427 | A | | 12/1973 | Ewald | |
| 3,848,778 | A | | 11/1974 | Meshberg | |
| 3,904,088 | A | | 9/1975 | Milbourne, Sr. | |
| 4,418,842 | A | | 12/1983 | Di Loreto | |
| 4,424,920 | A | * | 1/1984 | Tada | 222/402.11 |
| 4,482,082 | A | * | 11/1984 | Goncalves | 222/182 |
| 4,506,808 | A | * | 3/1985 | Goncalves | 222/182 |
| 4,513,890 | A | | 4/1985 | Goncalves | |
| 4,541,541 | A | | 9/1985 | Hickman et al. | |
| 4,542,837 | A | | 9/1985 | Rayner | |
| 4,776,491 | A | | 10/1988 | Nitta | |
| 5,018,647 | A | | 5/1991 | Abplanalf | |
| 5,027,982 | A | | 7/1991 | Demarest | |
| D323,117 | S | | 1/1992 | Demarest | |
| 5,388,730 | A | | 2/1995 | Abbott et al. | |
| 5,464,112 | A | | 11/1995 | Guillot | |
| 5,649,645 | A | | 7/1997 | Demarest et al. | |
| 5,918,774 | A | | 7/1999 | Lund et al. | |
| 6,302,302 | B1 | | 10/2001 | Albisetti | |
| 6,691,896 | B2 | | 2/2004 | Meshberg | |
| 6,758,373 | B2 | | 7/2004 | Jackson et al. | |
| 6,896,160 | B2 | | 5/2005 | Kaufman et al. | |
| 6,932,244 | B2 | | 8/2005 | Meshberg | |
| 6,971,552 | B2 | | 12/2005 | Meshberg | |
| 7,017,785 | B2 | | 3/2006 | Lasserre et al. | |
| 7,036,691 | B2 | | 5/2006 | Nicolas | |
| 7,104,424 | B2 | | 9/2006 | Kolanus | |
| 7,104,427 | B2 | | 9/2006 | Pericard et al. | |
| 7,156,266 | B2 | | 1/2007 | Delage | |
| 7,157,076 | B2 | | 1/2007 | Pataut et al. | |
| D536,969 | S | | 2/2007 | Geier | |
| D537,715 | S | | 3/2007 | Downey et al. | |
| D565,947 | S | | 4/2008 | Downey et al. | |
| 7,487,891 | B2 | | 2/2009 | Yerby et al. | |
| 7,530,476 | B2 | | 5/2009 | Downey et al. | |
| 7,611,032 | B2 | | 11/2009 | Brunerie et al. | |
| 7,699,190 | B2 | | 4/2010 | Hygema | |
| 7,757,905 | B2 | | 7/2010 | Strand et al. | |
| D627,638 | S | | 11/2010 | Bodet et al. | |
| 7,854,256 | B2 | | 12/2010 | Pineo et al. | |
| 7,922,041 | B2 | | 4/2011 | Gurrisi et al. | |
| 7,967,224 | B2 | | 6/2011 | Belau et al. | |
| 7,984,827 | B2 | | 7/2011 | Hygema | |
| 8,100,298 | B2 | | 1/2012 | Marquardt et al. | |
| 8,127,968 | B2 | | 3/2012 | Yerby et al. | |
| D665,669 | S | | 8/2012 | Folli et al. | |
| D666,491 | S | | 9/2012 | Adams et al. | |
| 8,286,830 | B2 | | 10/2012 | Hygema | |
| 8,418,892 | B2 | | 4/2013 | Geier | |
| 8,474,663 | B2 | | 7/2013 | Westphal | |
| 8,517,227 | B2 | | 8/2013 | Strand et al. | |
| 8,622,256 | B2 | | 1/2014 | Campbell | |
| 2006/0201970 | A1 | | 9/2006 | Jasek | |
| 2008/0179347 | A1 | | 7/2008 | Yerby et al. | |
| 2012/0024894 | A1 | | 2/2012 | Westphal | |
| 2012/0037668 | A1 | | 2/2012 | Bicknell et al. | |
| 2014/0183228 | A1 | * | 7/2014 | Decea et al. | 222/153.11 |

FOREIGN PATENT DOCUMENTS

| | | |
|---|---|---|
| JP | 2010274984 | 12/2010 |
| JP | 2011005469 | 1/2011 |

OTHER PUBLICATIONS

Written Opinion dated Apr. 30, 2014 corresponding to International Application No. PCT/US2013/076186; 6 pages.

* cited by examiner

CAP FOR DISPENSING LIQUIDS OR GELS

BACKGROUND OF THE DISCLOSURE

1. Field of the Disclosure

The present disclosure relates to an assembly for storing and dispensing liquids or gels. More particularly, the present disclosure relates to a cap for dispensing liquids or gels.

2. Description of Related Art

Containers that store and dispense liquids or gels include aerosol containers as are known in the art. Aerosol containers hold a product, for example, a liquid or gel, and a propellant, for example, liquefied-gas propellant under pressure. The propellant urges the product out of the container through an aperture in a cap connected to the container upon a user activating the actuator, such as by a pushbutton located in the cap, to open a valve. Conventional caps undesirably accumulate build-up of the product around the aperture after use. This build-up can lead to clogging of the aperture which is detrimental to operation of the aerosol container and, thus, raises sanitation concerns.

Conventional aerosol containers allow access to the actuator, such as the pushbutton located in the cap, in both open and closed positions. Such containers require a device that prevents movement of the pushbutton even if a force is applied to the pushbutton by the user in the closed position. In addition, these containers do not indicate to a user whether the container has been tampered with prior to use.

Therefore, it has been determined by the present disclosure that there is a need for a cap, which minimizes build-up. There is a further need for a cap that minimizes or prevents a user from accessing the actuator in the closed position. There is a still further need for a dispenser cap with a tamper indicator that minimizes or prevents a user from accessing the actuator prior to use.

BRIEF SUMMARY OF THE DISCLOSURE

The present disclosure provides a cap for a container that stores and dispenses fluids or gels. The cap includes a shroud having a shroud wall surrounding an opening and a collar connected on the shroud so that the collar selectively rotates relative to the shroud. The collar is rotatable between a closed position and an open position. An actuator is connected to the shroud, and the actuator has a contact portion that is in the opening of the shroud. The actuator is movable in both the closed position and the open position by a force that is applied to the contact portion.

The above-described and other features and advantages of the present disclosure will be appreciated and understood by those skilled in the art from the following detailed description, drawings, and appended claims.

DETAILED DESCRIPTION OF THE DISCLOSURE

Figure 1:
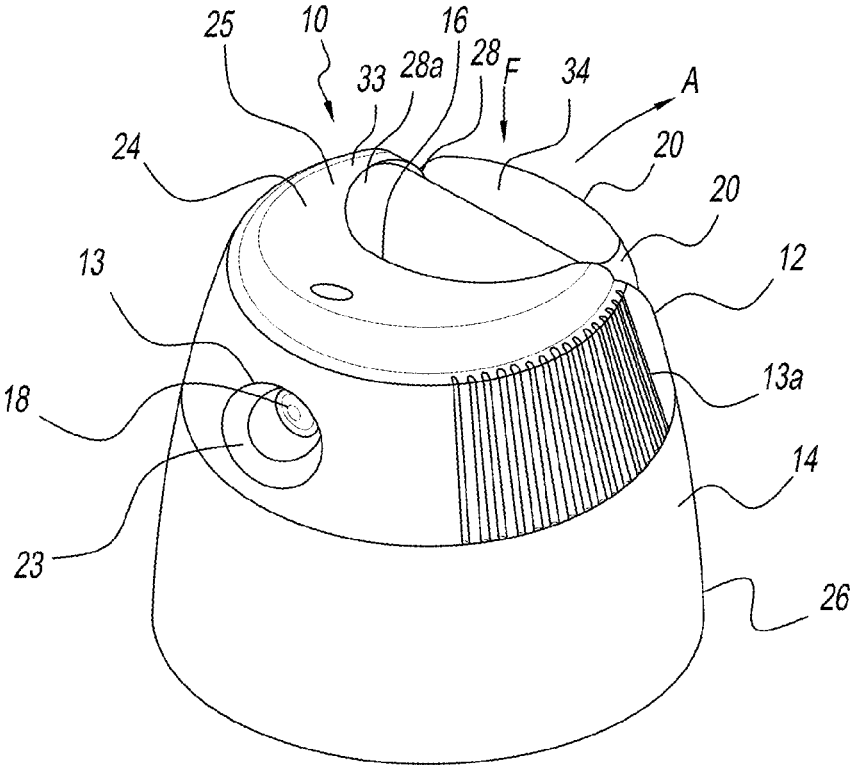
FIG. 1 is a top side perspective view of a first exemplary embodiment of a dispenser cap in an open position and having a tab in a connected position.

Referring to the drawings and in particular to FIG. 1, a first exemplary embodiment of a dispenser cap according to the present disclosure is shown in an opened position and is generally referred to by reference numeral 10. Dispenser cap 10 has a collar 12, a shroud 14, an actuator 16 and an insert 18. Dispenser cap 10 connects to a container, for example, an aerosol container as is known in the art, for holding a product, for example, a liquid or gel, and a propellant, for example, liquefied-gas propellant under pressure. The propellant may be a hydrocarbon, hydroflourocarbon, carbon dioxide, nitrogen or any other suitable compressed gas. When dispenser cap 10 is connected to an aerosol container, a user applies a force, as shown by arrow F in FIG. 1, to actuator 16 to open a passageway for the product and/or propellant to pass through actuator 16 and insert 18. For example, a vertical force of 4.5 pounds is a sufficient force to depress actuator 16. Collar 12, shroud 14, actuator 16 and insert 18 are made of plastic, for example, polypropylene. Collar 12 and shroud 14 may be polypropylene with an erucimide coating.

Figure 2:
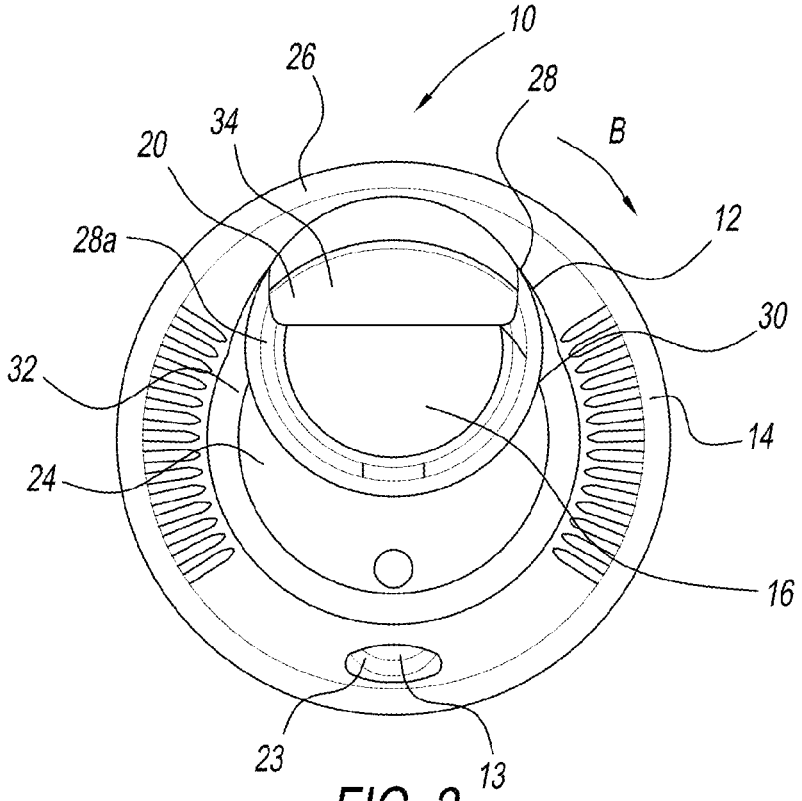
FIG. 2 is a top view of the dispenser cap of FIG. 1.
Figure 3:
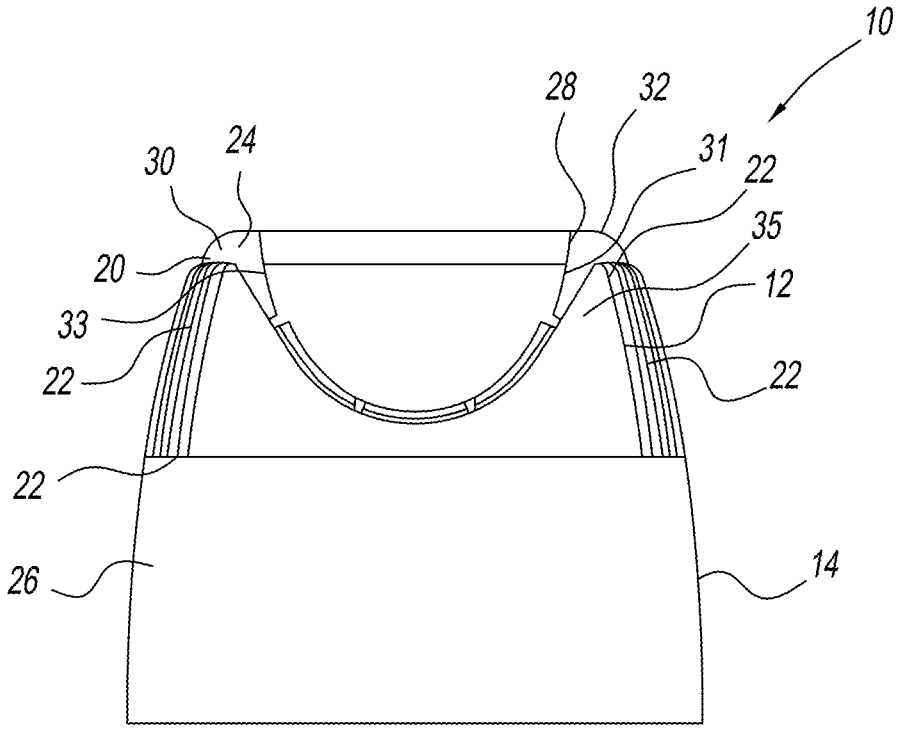
FIG. 3 is a rear view of the dispenser cap of FIG. 1.
Figure 14:
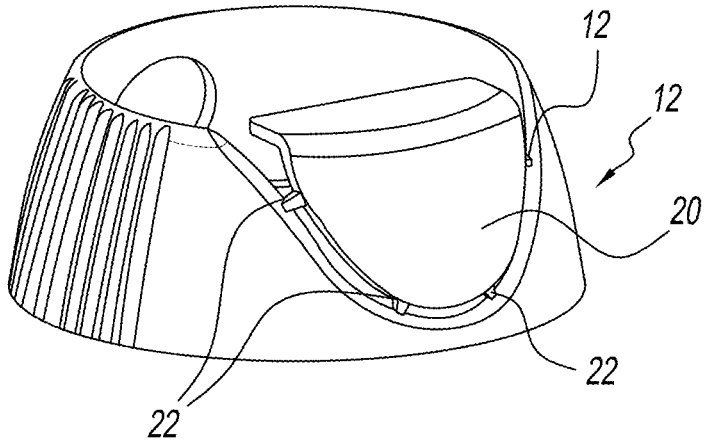
FIG. 14 is a rear side perspective view of the collar of FIG. 11.

Referring to FIGS. 1-3, collar 12 has a hole 13 through a collar wall 13*a* to provide access to actuator 16 and insert 18, and is connected to a tab 20 in a connected position. As shown in FIGS. 3 and 14, collar 12 is connected to tab 20 in the connected position by one or more connectors 22. Connector 22 is made of a material and/or is sized so that each connector 22 is frangible or able to be broken by a user. The user grasps tab 20 and applies a force, for example, as shown by arrow A in FIG. 1, to break connector 22 and remove tab 20 from collar 12. Connector 22 is made of a material, for example, Homo-Polymer PolyPropylene. Connector 22 may be sized to have, for example, 0.9 millimeter depth by 1.30 millimeter width by 1.80 millimeter length. In the connected position, tab 20 and connector 22 indicate to a user that dispenser cap 10 has not been used and provides evidence to the user that dispenser cap 10 has not been tampered with.

Referring again to FIG. 1, shroud 14 has an opening 28*a* surrounded by shroud wall 25 and a hole 23 through shroud wall 25. Collar 12 is connected to shroud 14 so that shroud 14 has a top shroud portion 24 on a first side of collar 12 and a bottom shroud portion 26 on an opposite side of collar 12. Shroud 14 has a shape that forms a space 28 between a first side portion 30 and a second side portion 32.

Collar 12 is connected to shroud 14 so that collar 12 can rotate relative to shroud 14, as shown by arrow B in FIG. 2. In the connected position, tab 20 has a top tab portion 34 that is sized to fit between first side portion 30 and second side portion 32 of top shroud portion 24 of shroud 14 to minimize or prevent rotation of collar 12 on shroud 14.

Referring to FIG. 2, top tab portion 34 and top shroud portion 24 are sized to minimize or prevent user access to actuator 16 between top tab portion 34 and top shroud portion 24 to minimize or prevent the force, as shown by arrow F in FIG. 1, from being applied to actuator 16 thereby preventing the contents of the container connected to dispenser cap 10 from being dispensed. Top tab portion 34 is about 30 percent a size of opening 28*a*.

Figure 4:
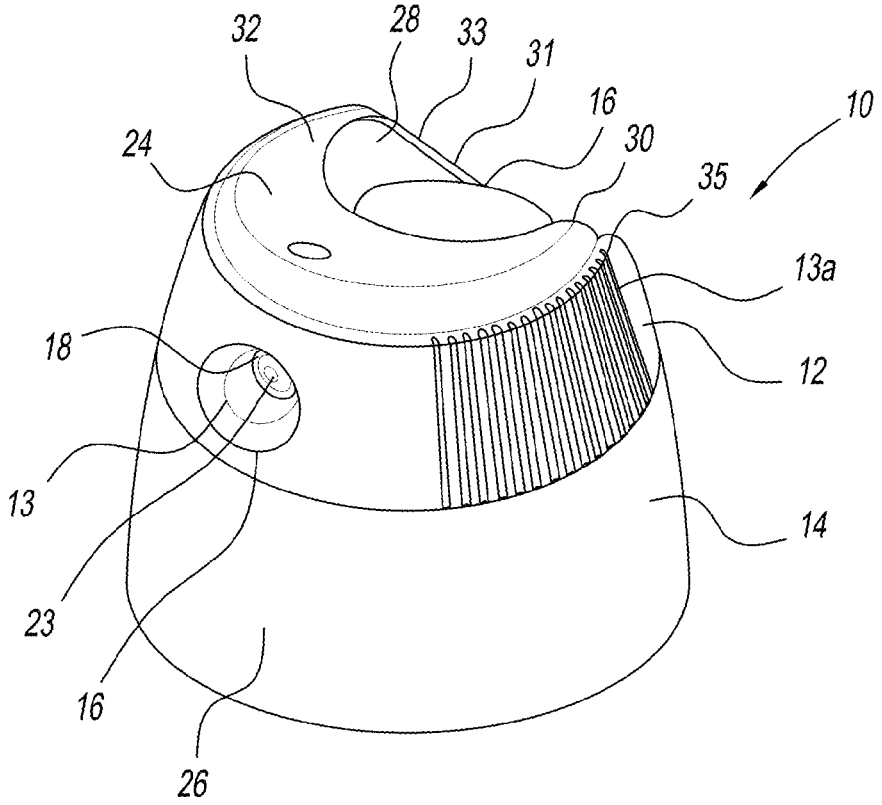
FIG. 4 is a top side perspective view of the dispenser cap of FIG. 1 in the open position and having the tab removed.
Figure 5:
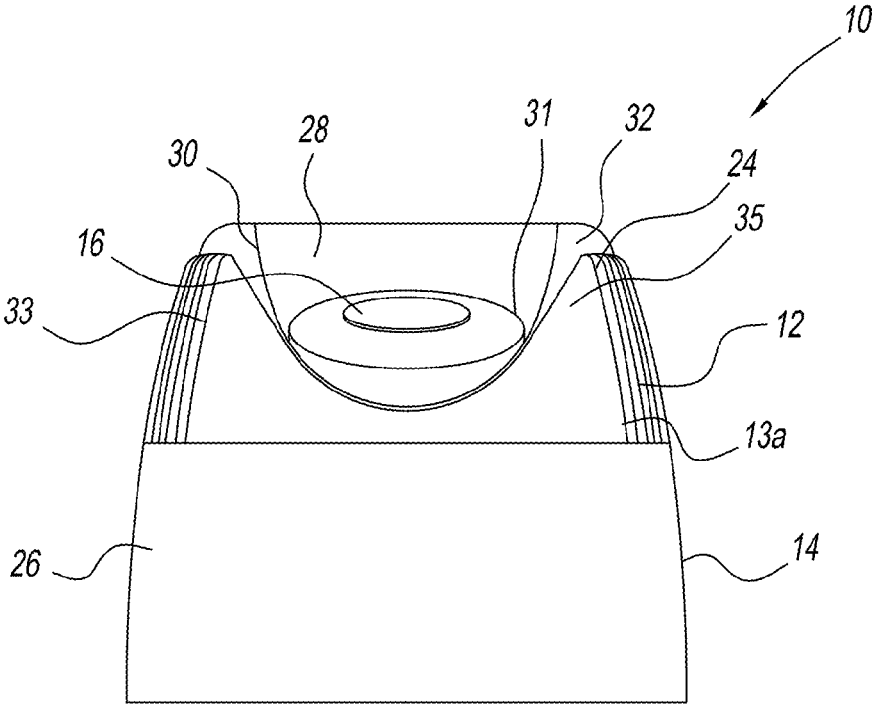
FIG. 5 is a rear view of the dispenser cap of FIG. 4.
Figure 6:
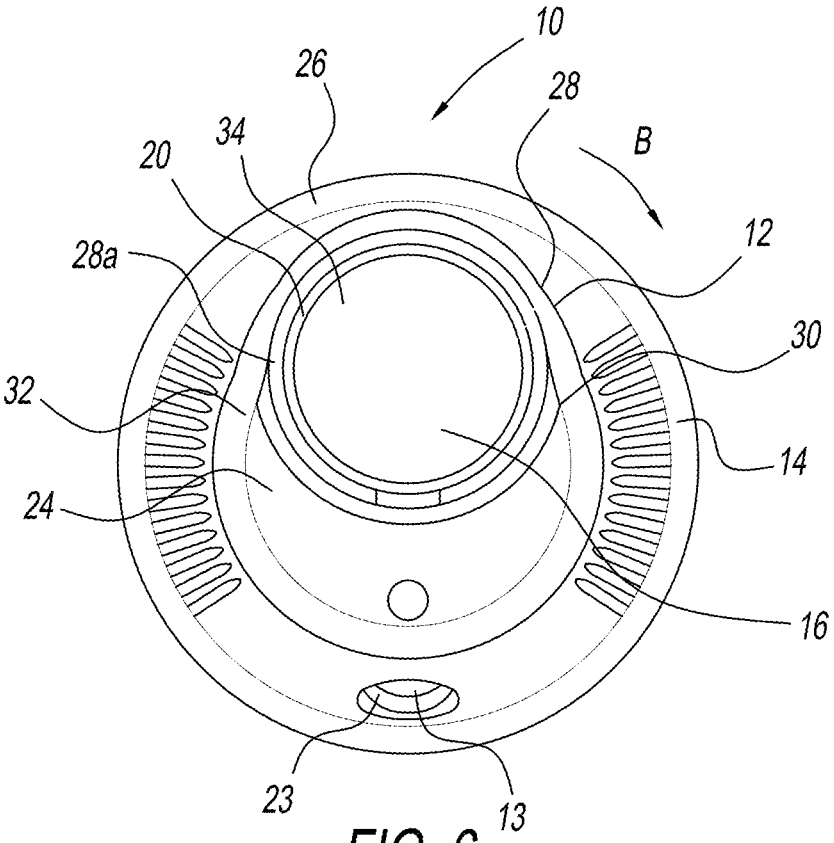
FIG. 6 is a top view of the dispenser cap of FIG. 4.

Referring to FIGS. 4-6, once tab 20 is removed, collar wall 13*a* forms a space 31 between a first collar portion 33 and a second collar portion 35. Space 31 may be U-shaped. Space 31 is aligned with space 28 in shroud 14 so that space 31 and space 28 allow greater access to actuator 16 ("the open position"). Thus, the force, shown by arrow F in FIG. 1, can be applied to actuator 16 to dispense the contents of the container connected to dispenser cap 10. For example, a finger of the user can extend through space 31 in collar 12 and space 28 in shroud 14 to contact actuator 16. Once tab 20 is removed, collar 12 can rotate relative to shroud 14, as shown by arrow B in FIGS. 2 and 6.

Figure 7:
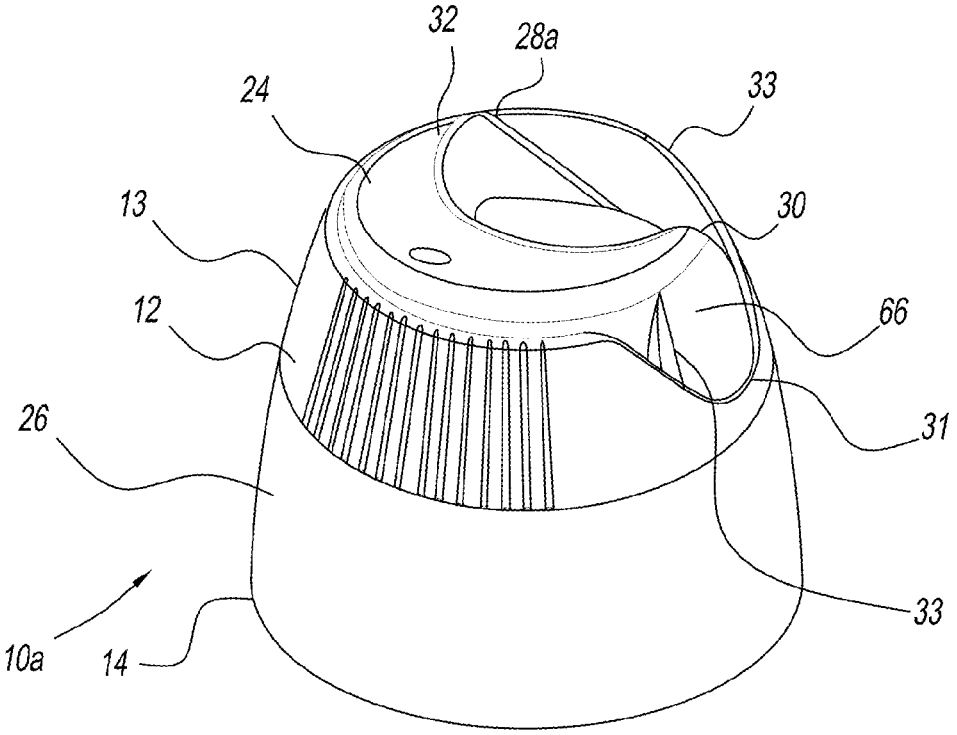
FIG. 7 is a top side perspective view of a dispenser cap that is similar to the dispenser cap of FIG. 1 in a closed position and having the tab removed.
Figure 8:
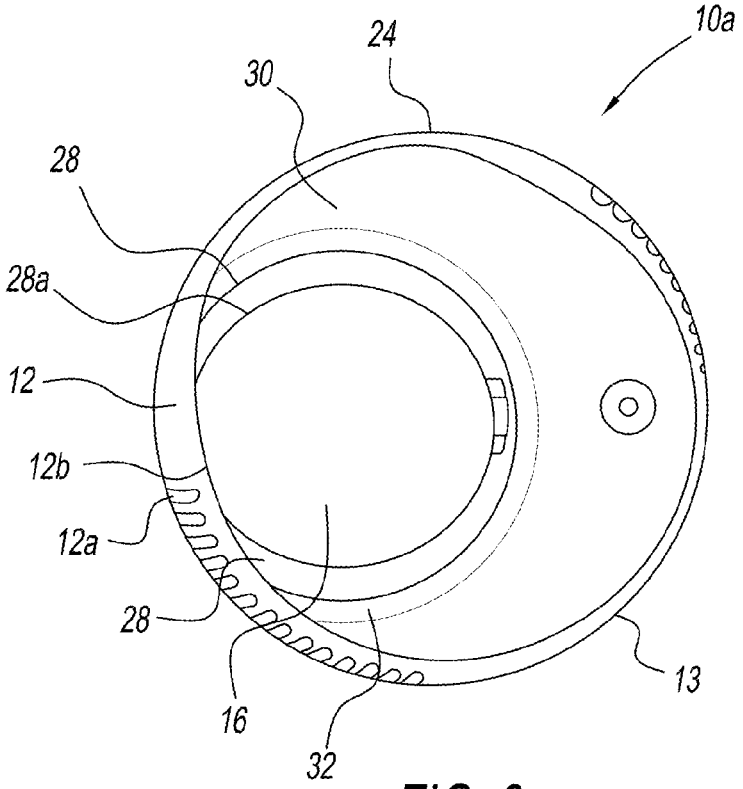
FIG. 8 is a top view of the dispenser cap of FIG. 7.
Figure 9:
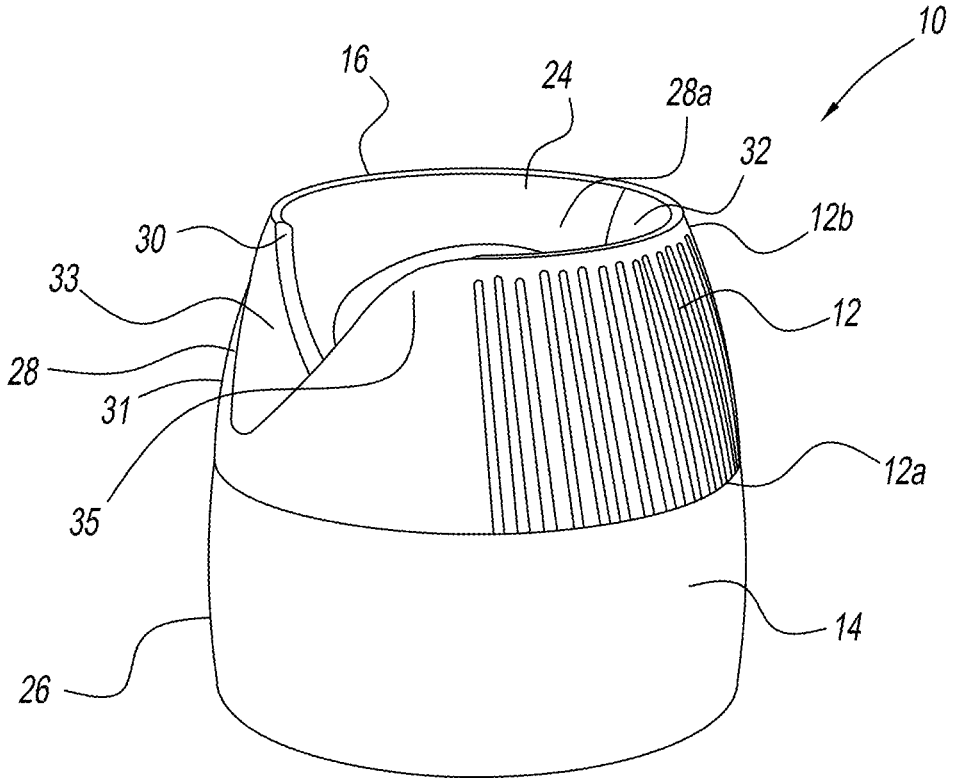
FIG. 9 is a rear view of the dispenser cap of FIG. 7.

Referring to FIG. 7, a dispenser cap 10*a* is shown that is similar to dispenser cap 10, however, some of the dimensions and colors differ from dispenser cap 10. Features of dispenser cap 10*a* that are the same as dispenser cap 10 are identified by the same reference numerals. Dispenser cap 10*a* has tab 20 removed and collar 12 is rotated, as shown by arrow B in FIGS. 2 and 6, thereby moving hole 13 of collar 12 to a position as shown in FIG. 8. In this position, hole 13 of collar 12 and hole 23 of shroud 14 are no longer aligned and collar 12 covers hole 23 of shroud 14. This is the closed position. Referring to FIG. 9, space 31 of collar 12 is moved after rotation of collar 12 so that it is no longer aligned with space 28 of shroud 14 in this closed position. A finger of the user can no longer extend through space 31 in collar 12 and space 28 in shroud 14 to contact actuator 16.

Referring to FIG. 8, collar 12 has a shape that reduces in size from a bottom edge 12*a* to a top edge 12*b*. Top edge 12*b* of collar 12 covers a portion of space 28 above actuator 16 in the closed position to minimize or prevent the finger of the user from accessing actuator 16 between top edge 12*b* of collar 12 and shroud 14 to apply the force, as shown by arrow F in FIG. 1, on actuator 16.

Figure 9A:
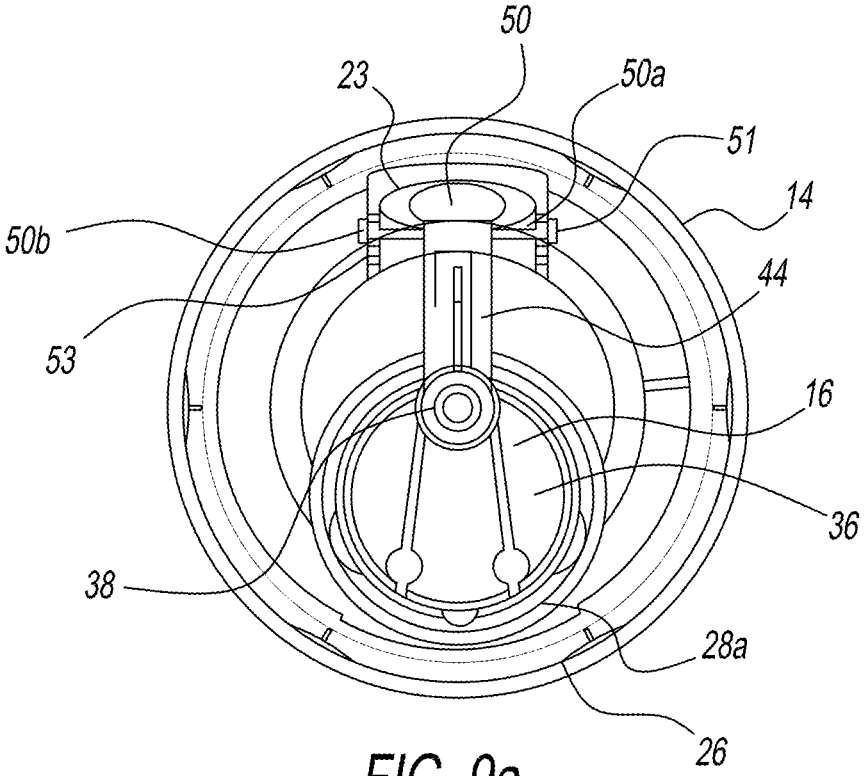
FIG. 9*a* is a bottom view of the dispenser cap of FIG. 7.
Figure 10:
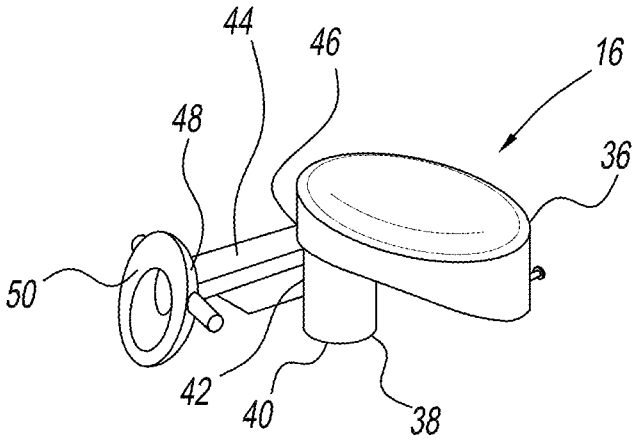
FIG. 10 is a top side perspective view of an actuator of FIG. 1.

Referring to FIGS. 9*a*-10, actuator 16 has a contact portion 36 that is in opening 28*a*. Contact portion 36 is connected to a connection portion 38. Referring to FIG. 10, a first end 40 of connection portion 38 connects to the container connected to dispenser cap 10, for example, connection portion 38 connects to a tube that receives the propellant and/or product being dispensed from the container. A second end 42 of connection portion 38 is connected to a first end 46 of a conduit 44. First end 46 of conduit 44 also connects to contact portion 36. Conduit 44 has a second end 48 that connects to an insert portion 50.

Referring to FIG. 9*a*, insert portion 50 is connected to protrusions 50*a* and 50*b* on opposite sides of insert portion 50. Protrusions 50*a* and 50*b* each fit in one of holders 51 and 53 connected to shroud 14. Holders 51 and 53 are C-shaped so that each has an opening. Protrusions 50*a* and 50*b* and/or holders 51 and 53 may be flexible so that protrusions 50*a* and 50*b* each fit through the opening of one of holders 51 and 53 and are held therein by snap fit. Protrusions 50*a* and 50*b* and holders 51 and 53 form a cantilevered connection between shroud 14 and actuator 16 so that a force, as shown by arrow F in FIG. 1, may be applied to contact portion 36 to move contact portion 36 while protrusions 50*a* and 50*b* maintain a connection with holders 51 and 53. Actuator 16 has flexibility so that when the force, as shown by arrow F in FIG. 1, is no longer applied to actuator 16, actuator 16 moves in a direction opposite to the force, as shown by arrow F in FIG. 1, and returns to its initial position prior to the force being applied.

Figure 10A:
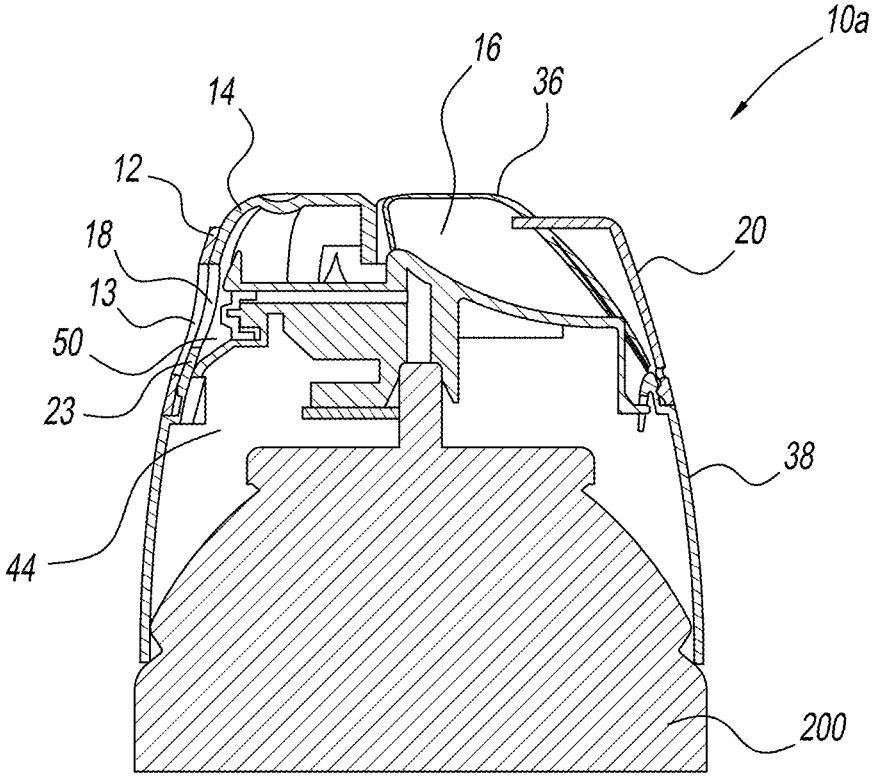
FIG. 10*a* is a side cross-sectional view of the dispenser cap of FIG. 7 in the open position with the tab being in the connected position.

Insert portion 50 receives insert 18 therein. Conduit 44 connects connection portion 38 to insert portion 50 so that fluid can flow from connection portion 38 through conduit 44, through insert portion 50, and through insert 18 out of dispenser cap 10. As discussed above, the user applies a force, as shown by arrow F in FIG. 1, to actuator 16 to open a passageway for the product and/or propellant to pass through actuator 16 and insert 18. Referring to FIG. 10*a*, dispenser cap 10*a* is connected to an aerosol container 200.

Figure 11:
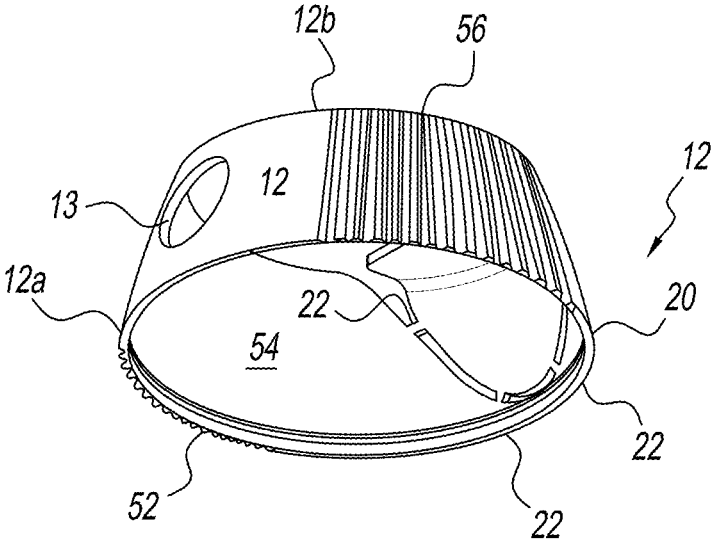
FIG. 11 is a bottom side perspective view of a collar of the dispenser cap of FIG. 1 having the tab in the connected position.

Referring to FIG. 11, collar 12 has a protrusion 52 on an interior surface 54 thereof. Protrusion 52 is adjacent bottom edge 12*a*, and is continuous about a perimeter of collar 12. Alternatively, but less preferably, protrusion 52 may be discontinuous. Collar 12 has ridges 56 on an exterior surface 58. Ridges 56 can assist for gripping by the user during rotation of collar 12.

Figure 12:
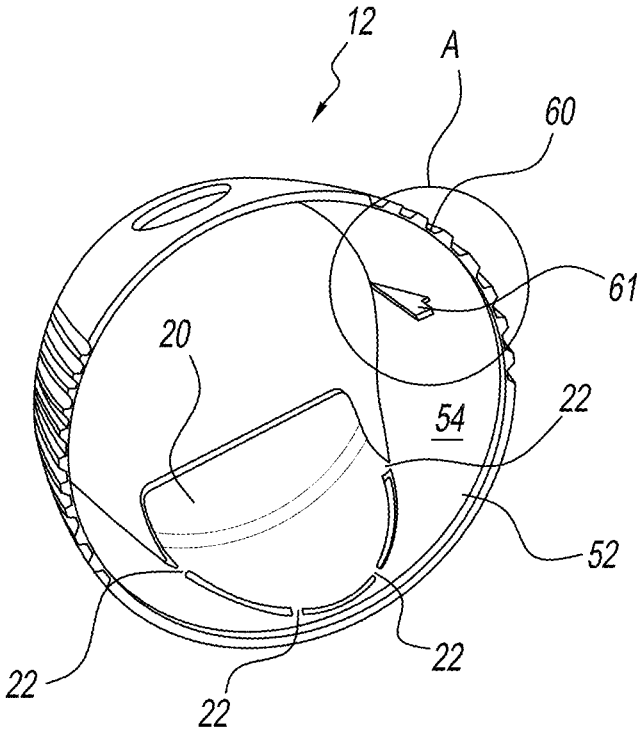
FIG. 12 is bottom front perspective view of the collar of FIG. 11.
Figure 13:
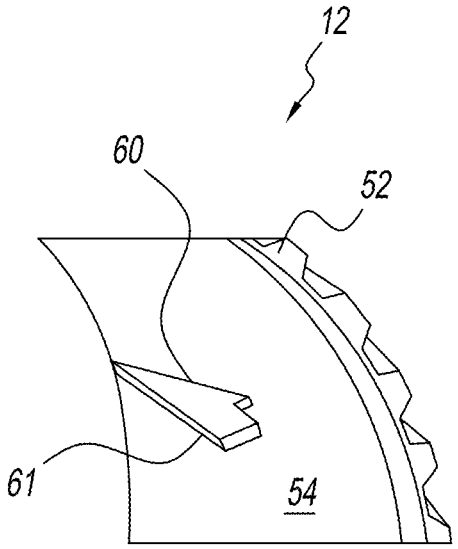
FIG. 13 is a partial enlarged portion of the collar designated by A in FIG. 12.

Referring to FIGS. 12-13, interior surface 54 has a collar rib 60. Collar rib 60 protrudes from interior surface 54. Collar rib 60 extends in a direction from top edge 12*b* to bottom edge 12*a* of collar 12. Collar rib 60 has a tip 61 that is flexible. Collar 12 may have collar rib 60 molded on interior surface 54.

Figure 15:
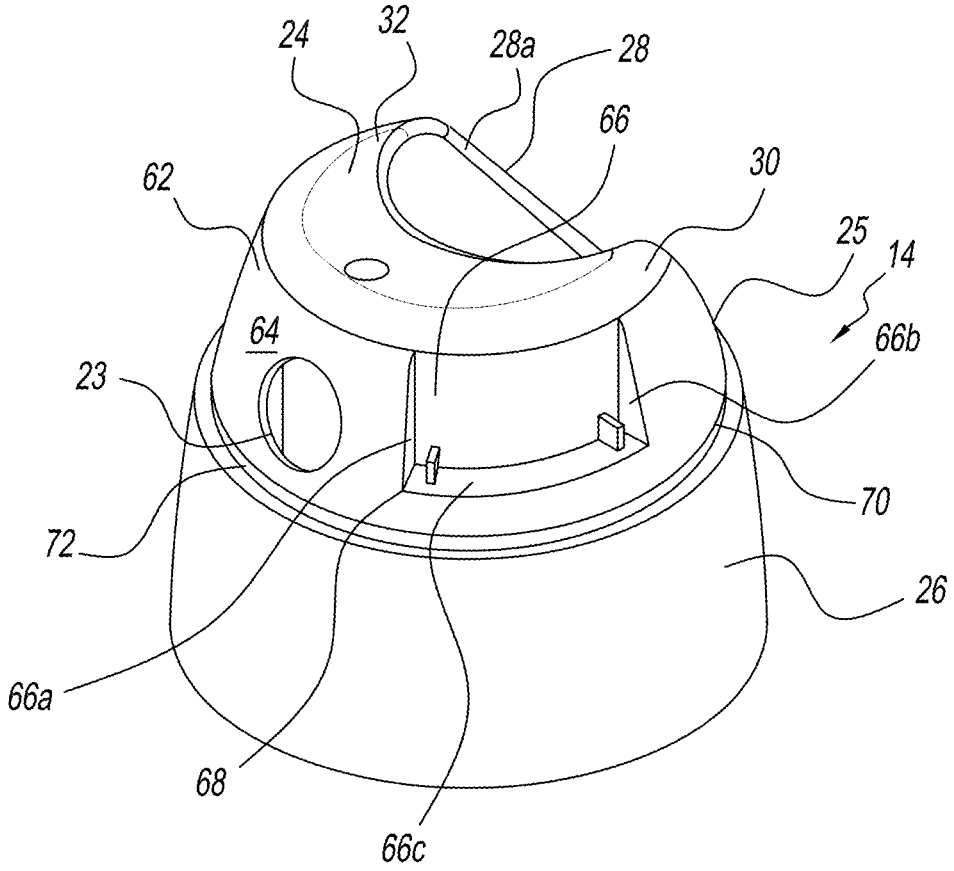
FIG. 15 is a top side perspective view of a shroud of the dispenser cap of FIG. 1.
Figure 16:
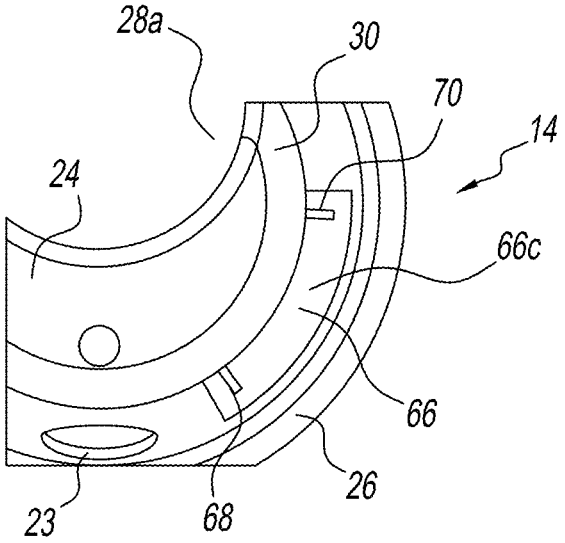
FIG. 16 is a partial top view of the shroud of FIG. 15.

Referring to FIGS. 15-16, shroud 14 has a middle shroud portion 62 between top shroud portion 24 and bottom shroud portion 26. Middle shroud portion 62 has an outer surface 64 that forms a depression 66. Depression 66 has a first side wall 66*a*, a second side wall 66*b* and a bottom wall 66*c* between first side wall 66*a* and second side wall 66*b*. Middle shroud portion 62 has a first shroud rib 68 and a second shroud rib 70 in depression 66. First shroud rib 68 and second shroud rib 70 may be rigid. First shroud rib 68 and second shroud rib 70 may be molded in depression 66. Outer surface 64 of middle shroud portion 62 forms a groove 72. Groove 72 is adjacent to bottom shroud portion 26. Groove 72 is sized and shaped to receive protrusion 52 of collar 12 as shown in FIGS. 12-13.

Figure 17:
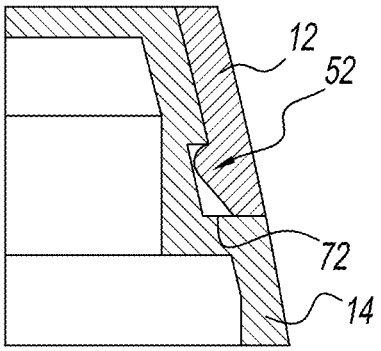
FIG. 17 is a partial cross-sectional view of the dispenser cap of FIG. 1.

Referring to FIG. 17, collar 12 is connected to shroud 14 by positioning protrusion 52 of collar 12 in groove 72 of shroud 14. This connection can be, for example, a snap fit. Groove 72 and protrusion 52 allow for rotation of collar 12 relative to shroud 14. Groove 72 and protrusion 52 maintain collar 12 connected to shroud 14. Collar 12 and shroud 14 include erucamide slip additive, for example, 4 grams per kilogram of polypropylene that achieves ease of rotation of collar 12 while not affecting the retention of collar 12 on shroud 14.

Figure 18:
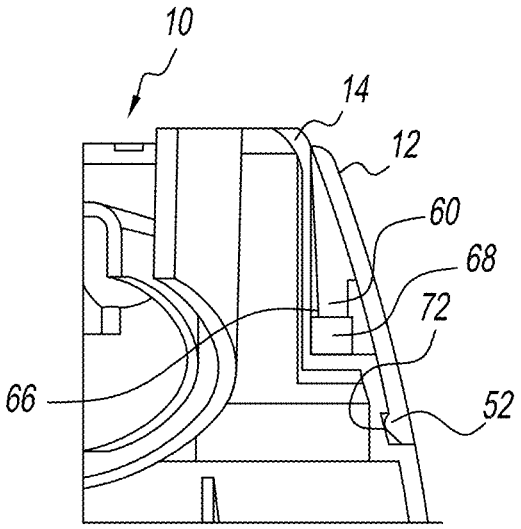
FIG. 18 is a partial cross-sectional view of the dispenser cap of FIG. 1.
Figure 19:
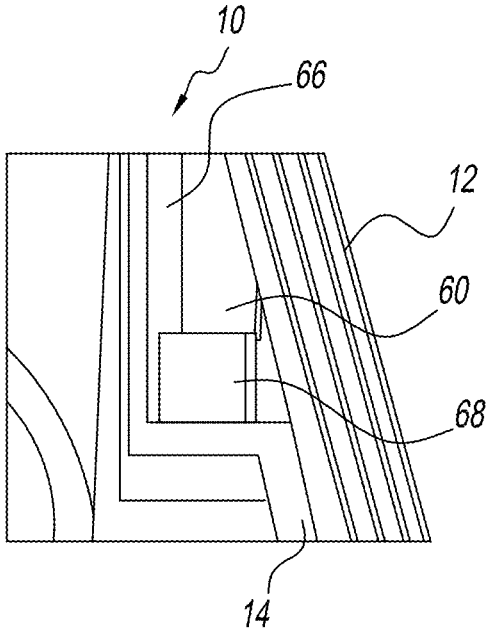
FIG. 19 is a partial cross-sectional view of the dispenser cap of FIG. 1.

Referring to FIGS. 18-19, collar 12 is connected to shroud 14 so that collar rib 60 extends into depression 66 formed by outer surface 64 of shroud 14. Collar rib 60 extends into depression 66 so that during rotation tip 61 of collar rib 60 contacts first shroud rib 68 and second shroud rib 70 deforming tip 61 of collar rib 60 and/or collar 12 allowing tip 61 of collar rib 60 to pass around each of first shroud rib 68 and second shroud rib 70. Collar rib 60 and tip 61 may be made of material, for example, homo-polymer polypropylene. The contact between tip 61 of collar rib 60 and each of first shroud rib 68 and second shroud rib 70 generates an audible noise or "click".

Figure 20:
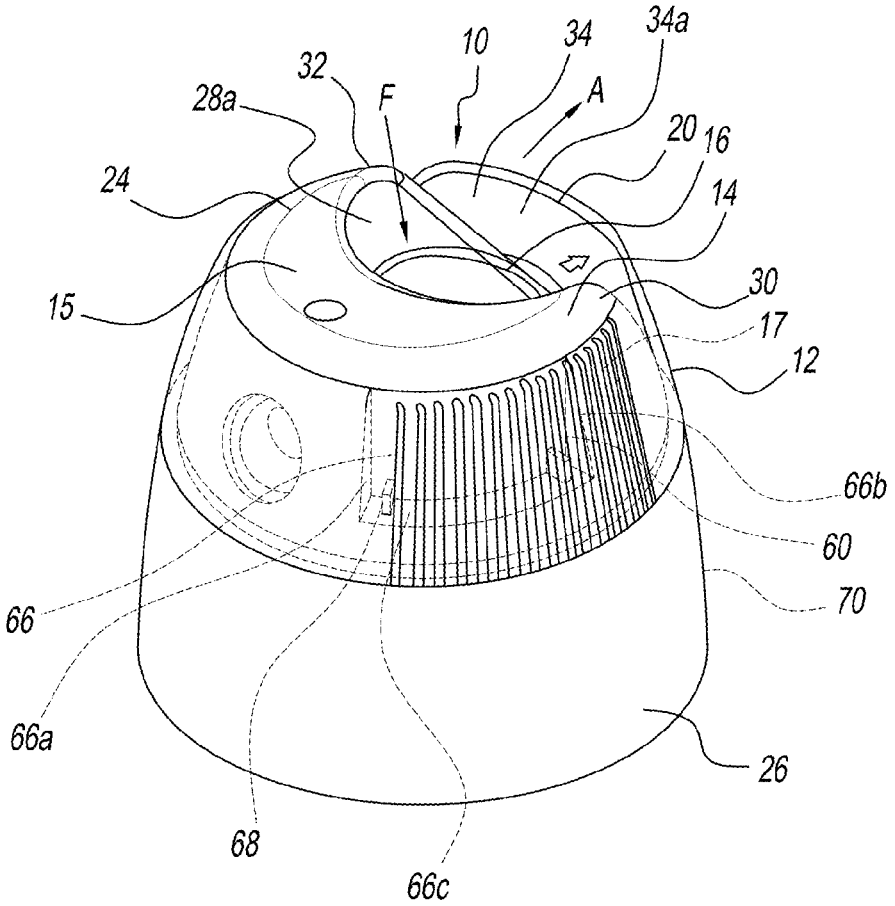
FIG. 20 is a top side perspective view of the dispenser cap of FIG. 1 with the collar shown as transparent.
Figure 21:
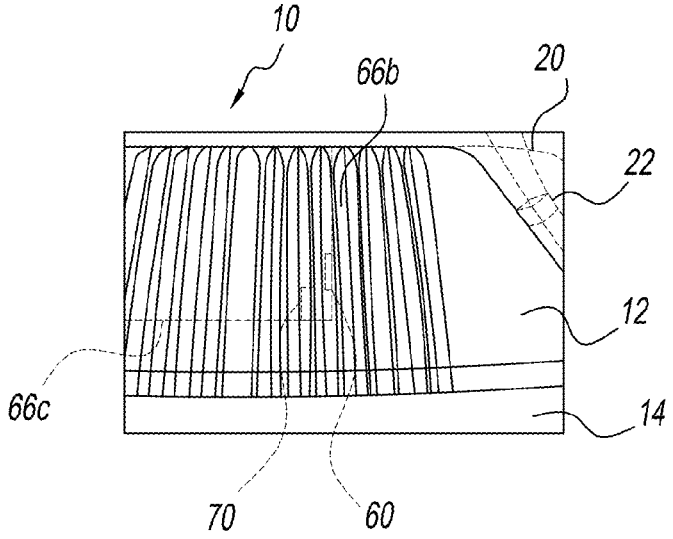
FIG. 21 is a partial side view of FIG. 20.

Referring to FIGS. 20-21, when tab 20 is in the connected position, dispenser cap 10 is in the open position. When dispenser cap 10 is in the open position, collar rib 60 is between second shroud rib 70 and second sidewall 66*b* of depression 66 formed in shroud 14. Top tab portion 34 and top shroud portion 24 are sized to minimize or prevent user access to actuator 16 between top tab portion 34 and top shroud portion 24 to thereby minimize or prevent the force, as shown by arrow F, from being applied to contact portion 36 of actuator 16 that would dispense the contents of the container connected to dispenser cap 10 when tab 20 is connected. The user grasps tab 20 and applies the force, for example, as shown by arrow A, to break connectors 22 and remove tab 20 from collar 12. Tab 20 has an indicator 34*a* indicating to a user a direction to apply a force to tab 20 to remove tab 20, for example, "TEAR OFF" with an arrows in the direction A is molded into tab portion 34.

Figure 22:
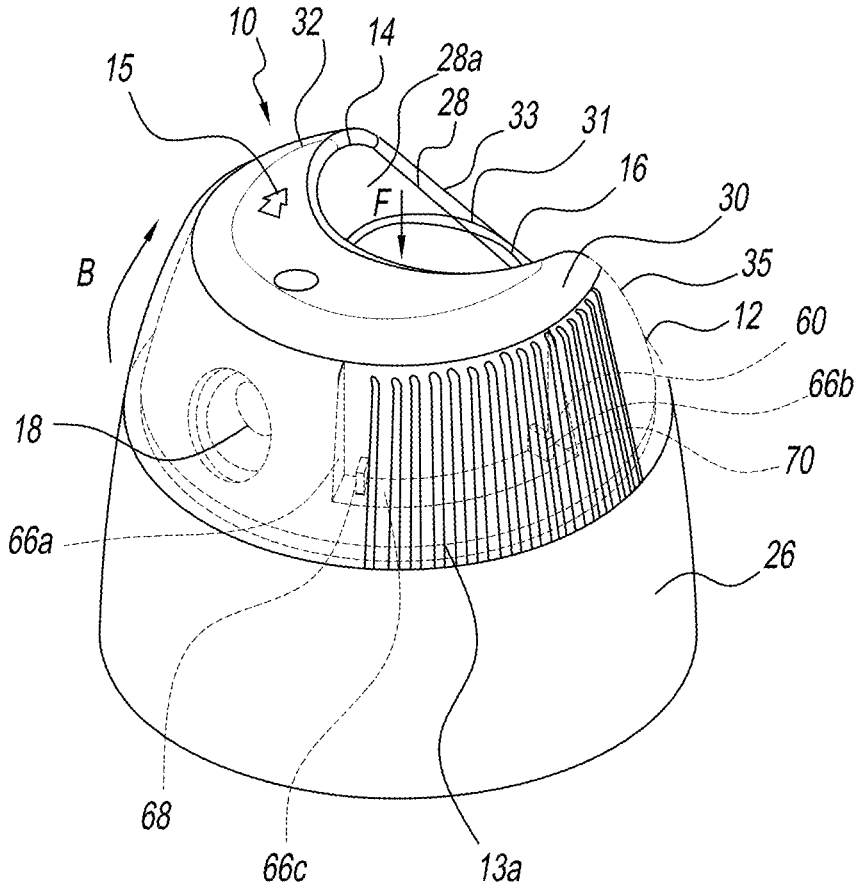
FIG. 22 is a top side perspective view of the dispenser cap of FIG. 1 with the collar shown as transparent and the tab removed.

Referring to FIG. 22, once tab 20 is removed, the finger of the user can extend through space 31 in collar 12 and space 28 in shroud 14 to contact actuator 16 to apply the force, as shown by arrow F, to dispense the contents of the container connected to dispenser cap 10. Dispenser cap 10 is maintained in the open position until a predetermined force is applied sufficient to move tip 61 of collar rib 60 to pass around second shroud rib 70.

Figure 23:
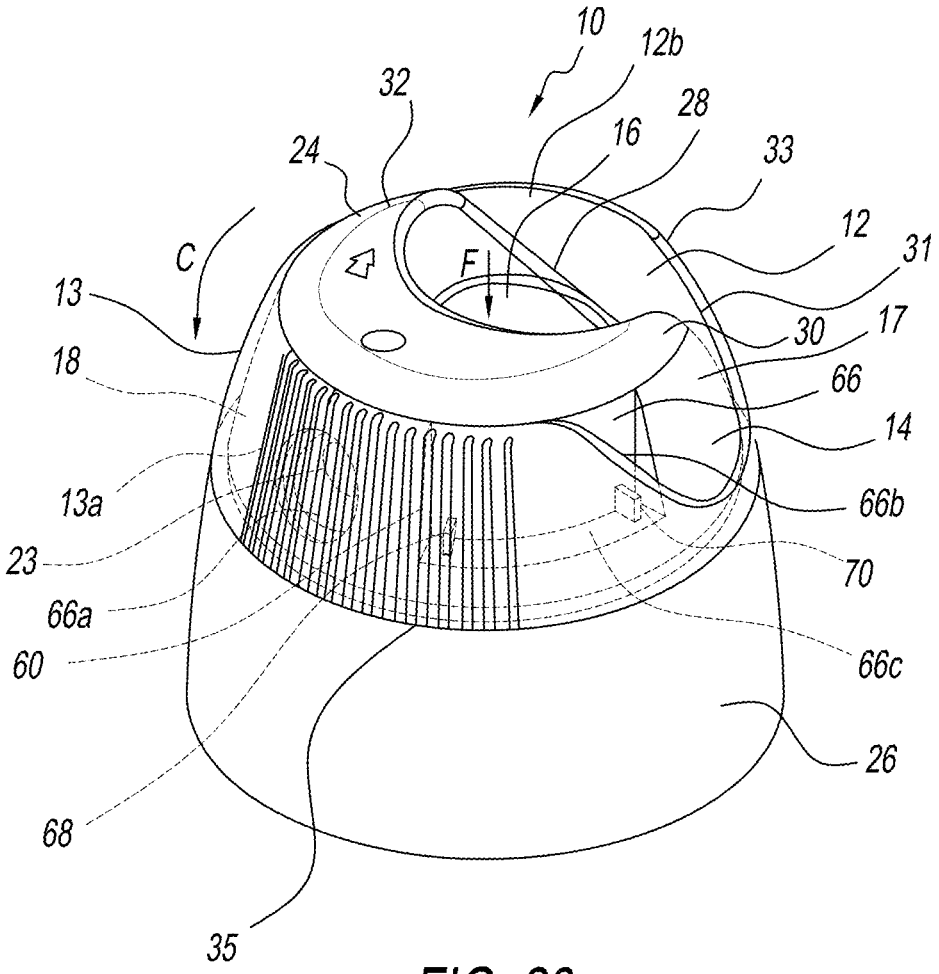
FIG. 23 is a top side perspective view of the dispenser cap of FIG. 1 with the collar shown as transparent, in the closed position and having the tab removed.
Figure 24:
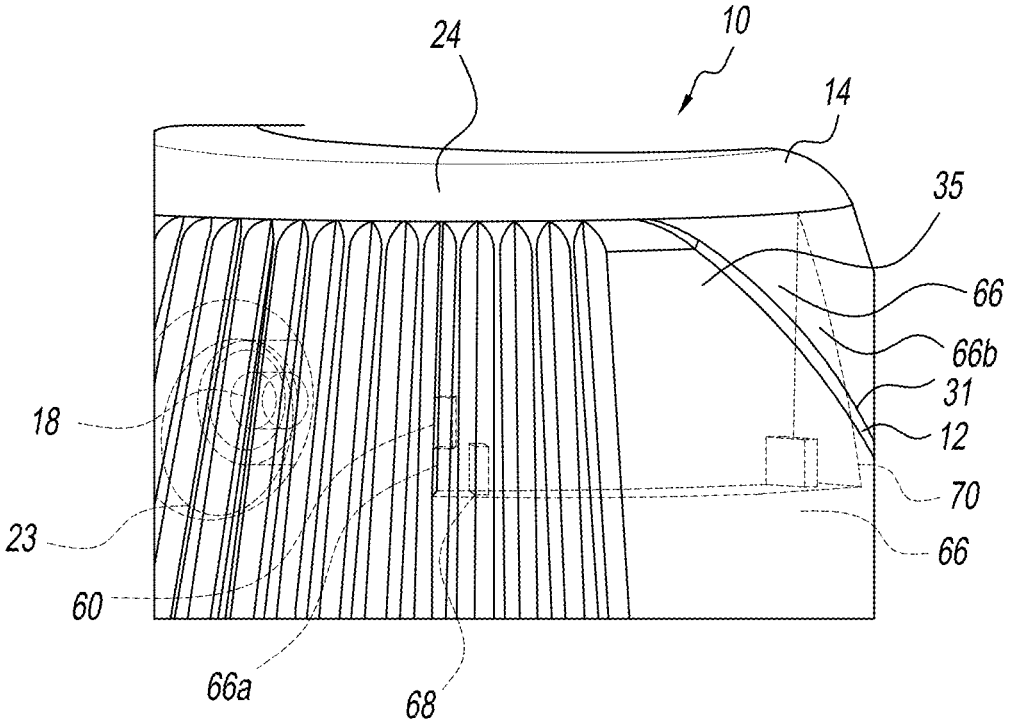
FIG. 24 is a partial side view of FIG. 23.

Once tab 20 is removed, collar 12 can rotate relative to shroud 14, as shown by arrow B, by application of a predetermined force. Shroud 14 has an indicator 15 to indicate to a user a direction to rotate collar 12 to move to the closed position, for example, "CLOSE" with an arrow is molded into top shroud portion 24. As collar 12 is rotated, for example, about 60 degrees, tip 61 of collar rib 60 passes over each of first shroud rib 68 and second shroud rib 70 to move to the closed position, as shown in FIGS. 23 and 24. The contact between tip 61 of collar rib 60 and each of first shroud rib 68 and second shroud rib 70 generates two audible noises or "clicks". The first click of the two clicks is generated as tip 61 of collar rib 60 is moved from the open position, and, then, the second click is generated as tip 61 of collar rib 60 is moved into the closed position. In the closed position, tip 61 of collar rib 60 is between first shroud rib 68 and first sidewall 66*a* of depression 66. Dispenser cap 10 is maintained in the closed position until a predetermined force is applied sufficient to move tip 61 of collar rib 60 to pass around first shroud rib 68. Top edge 12*b* of collar 12 covers a portion of contact portion 36 and space 31 of collar 12 is moved after rotation of collar 12 so that it is no longer aligned with space 28 of shroud 14 in the closed position. Access to actuator 16 is prevented or minimized in the closed position so that the user cannot apply the force, shown by arrow F, to dispense the contents of the container as collar 12 blocks access to actuator 16 and covers or hides hole 23 in shroud 14. However, contact portion 36 is movable in the closed position. Collar wall 13*a* may contact shroud wall 25 surrounding hole 23 in the closed position.

Collar 12 can rotate relative to shroud 14, as shown by arrow C in FIG. 23. As collar 12 is rotated, for example, about 60 degrees, collar rib 60 pass around each of first shroud rib 68 and second shroud rib 70 to move to the open position, as shown in FIG. 22. Shroud 14 has an indicator 17 for indicating to a user a direction to rotate collar 12 to move to the open position, for example, "OPEN" with an arrow is molded into middle shroud portion 62. The contact between tip 61 of collar rib 60 and each of first shroud rib 68 and second shroud rib 70 generates two audible noises or "clicks". The first click of the two clicks is generated as tip 61 of collar rib 60 is moved from the closed position, and, then, the second click is generated as tip 61 of collar rib 60 is moved into the open position. Once tab 20 is removed, dispenser cap 10 can selectively move to and from the open and closed positions as the user desires. Collar rib 60 rotates between first side wall 66*a* and second side wall 66*b* of depression 66 so that first side wall 66*a* and second side wall 66*b* restrict rotation of collar rib 60.

Figure 25:
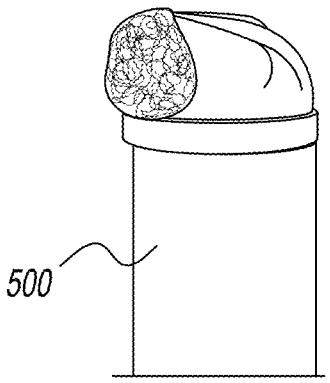
FIG. 25 is a side view of a conventional spray assembly.
Figure 26:
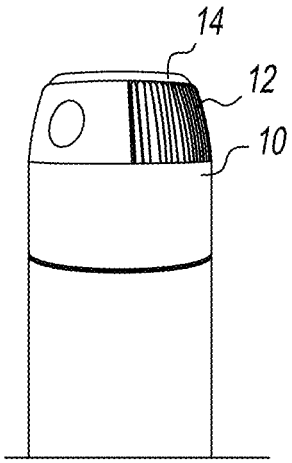
FIG. 26 is a side view of a spray assembly having the dispenser cap of FIG. 1.

Referring to FIG. 25, a conventional gel dispenser is shown. After use, there is a build-up of gel. In contrast, FIG. 26 shows a dispenser assembly including dispenser cap 10. After use, there is no build-up of gel on dispenser cap 10 in contrast to FIG. 25, or is hidden from view by collar 12 covering hole 23 in shroud 14. Advantageously, dispenser cap 10 minimizes or prevents undesirable build-up as well as minimizes or prevents dispensing of contents of a container connected to dispenser cap 10 by obstructing access to actuator 16 in the closed position or prior to use.

Figure 27:
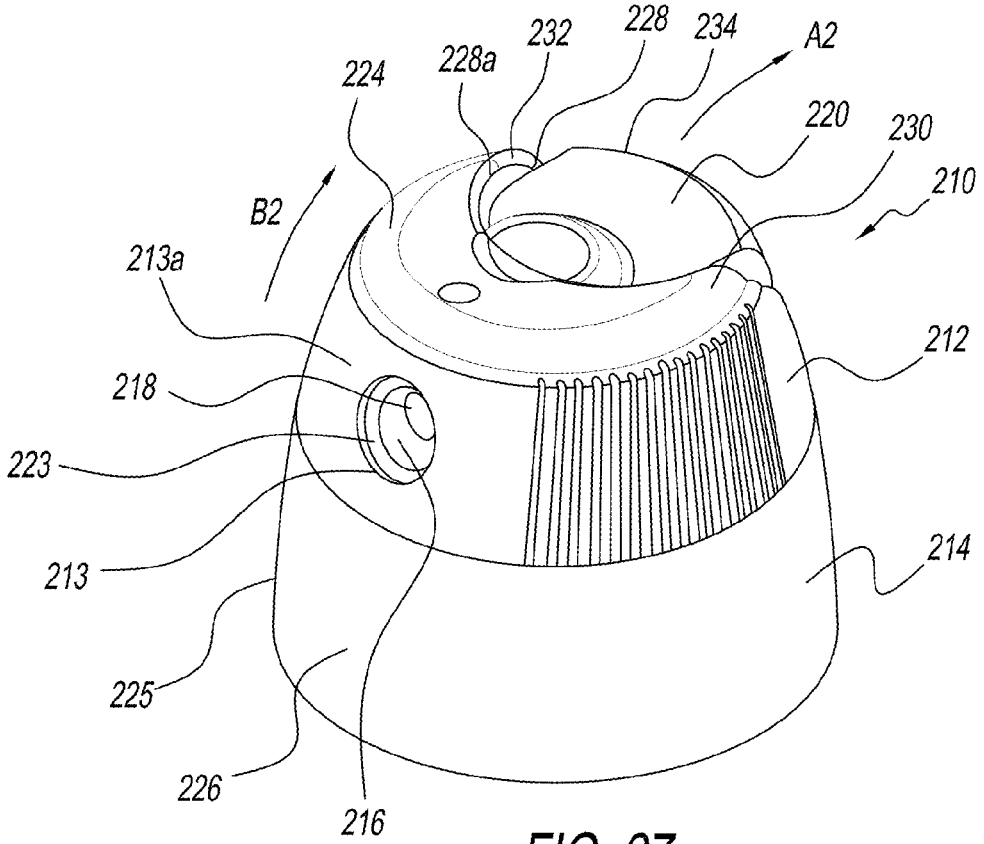
FIG. 27 is a top front perspective view of a second exemplary embodiment of a dispenser cap of the present disclosure in an open position and having a tab in a connected position.
Figure 30:
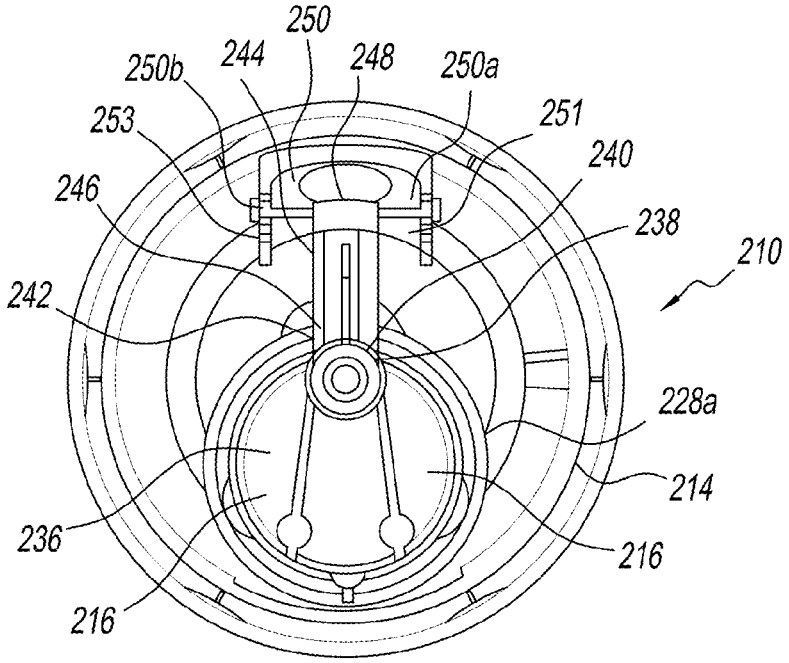
FIG. 30 is a bottom view of the dispenser cap of FIG. 27.
Figure 31:
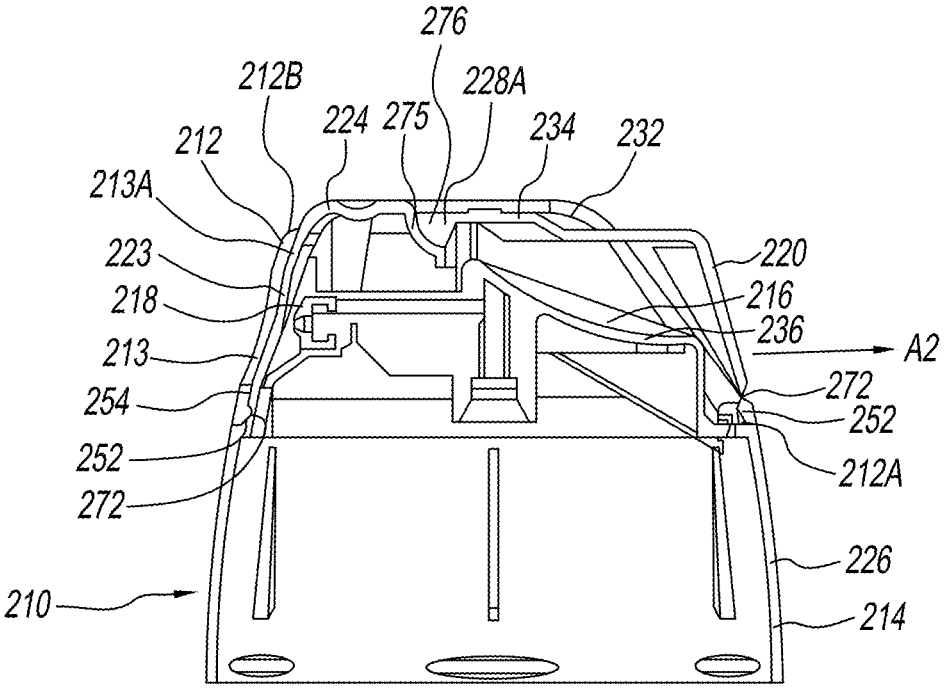
FIG. 31 is a side cross-sectional view of the dispenser cap of FIG. 27.

Referring to FIG. 27, a second exemplary embodiment of a dispenser cap according to the present disclosure is shown in an opened position and is generally referred to by reference numeral 210. Dispenser cap 210 has a collar 212, a shroud 214, as shown in FIGS. 30 and 31, an actuator 216 and, as shown in FIG. 27, an insert 218. Dispenser cap210 connects to a container, for example, an aerosol container as discussed above for dispenser cap 10. Collar 212, shroud 214, actuator 216 and insert 218 are made of plastic, for example, polypropylene. Collar 212 and shroud 214 may be polypropylene with an erucimide coating.

Figure 28:
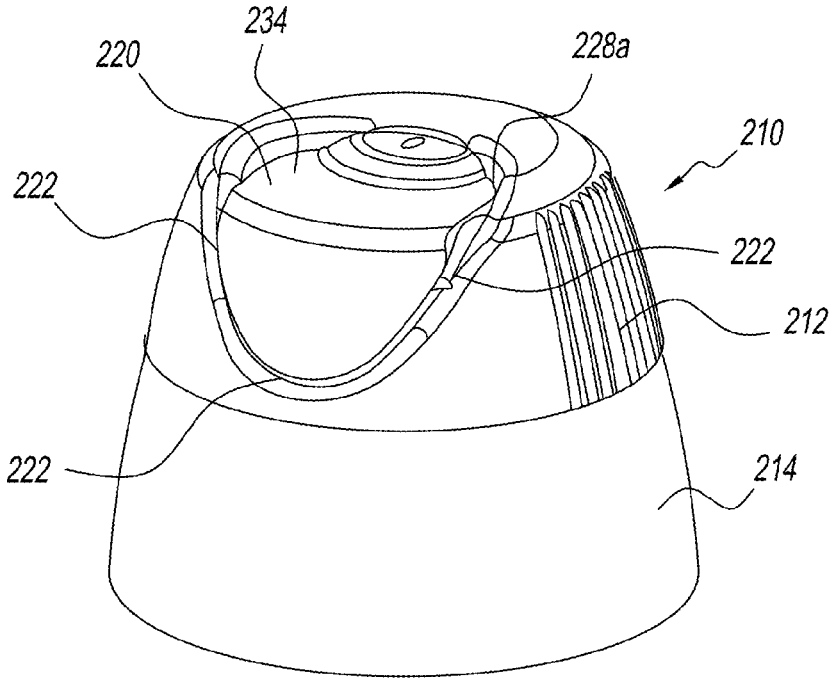
FIG. 28 is a top rear perspective view of the dispenser cap of FIG. 27.
Figure 29:
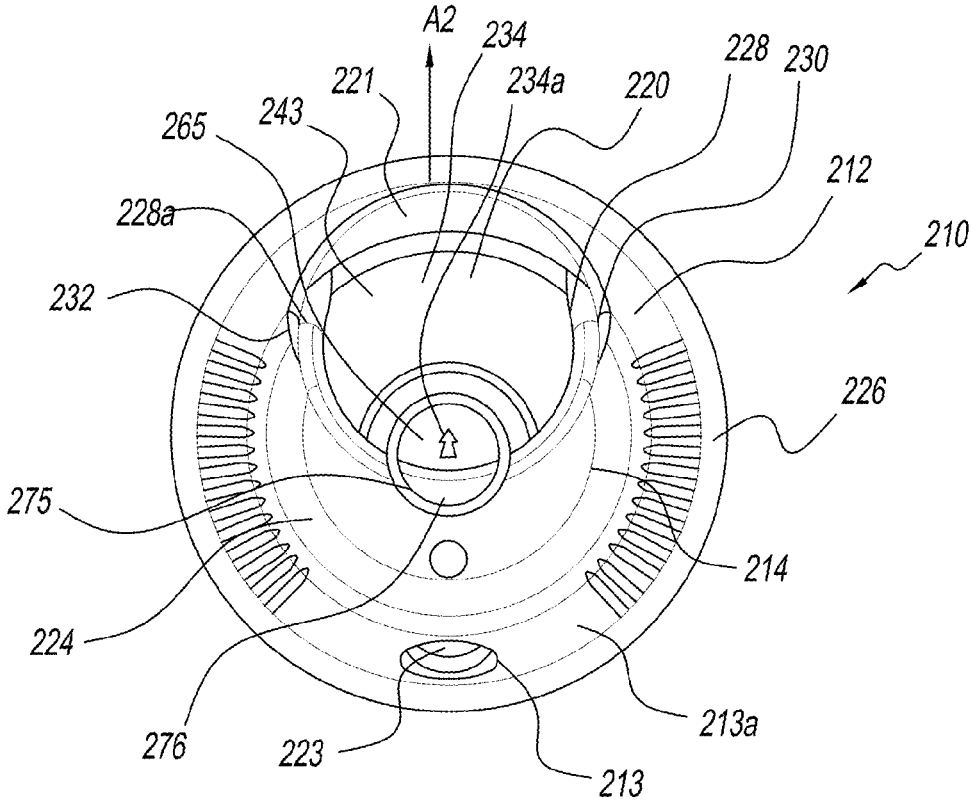
FIG. 29 is a top view of the dispenser cap of FIG. 27.

Referring to FIGS. 27-29, collar 212 has a hole 213 through a collar wall 213*a* to provide access to actuator 216 and insert 218, and is connected to a tab 220 in a connected position. As shown in FIG. 28, collar 212 is connected to tab 220 in the connected position by one or more connectors 222. Connector 222 is made of a material and/or is sized so that each connector 222 is frangible or able to be broken by a user. The user grasps tab 220 and applies a force, for example, as shown by arrow A2 in FIG. 27, to break connector 222 and remove tab 220 from collar 212. Connector 222 is made of a material, for example, homo-polymer polypropylene. Connector 222 may be sized to have, for example, 0.9 millimeter depth by 1.30 millimeter width by 1.80 millimeter length. In the connected position, tab 220 and connector 222 indicate to a user that dispenser cap 210 has not been used and provides evidence to the user that dispenser cap 210 has not been tampered with.

Referring again to FIG. 27, shroud 214 has an opening 228*a* surrounded by shroud wall 225 and a hole 223 through shroud wall 225. Collar 212 is connected to shroud 214 so that shroud 214 has a top shroud portion 224 on a first side of collar 212 and a bottom shroud portion 226 on an opposite side of collar 212. Shroud 214 has a shape that forms a space 228 between a first side portion 230 and a second side portion 232.

Collar 212 is connected to shroud 214 so that collar 212 can rotate relative to shroud 214, as shown by arrow B2. In the connected position, tab 220 has a top tab portion 234 that is sized to fit between first side portion 230 and second side portion 232 of top shroud portion 224 of shroud 214 to minimize or prevent rotation of collar 212 on shroud 214. Top tab portion 234 is between 20 percent to 100 percent of a size of opening 228*a*, and, most preferably 75 percent to 95 percent the size of opening 228*a*.

Figure 32:
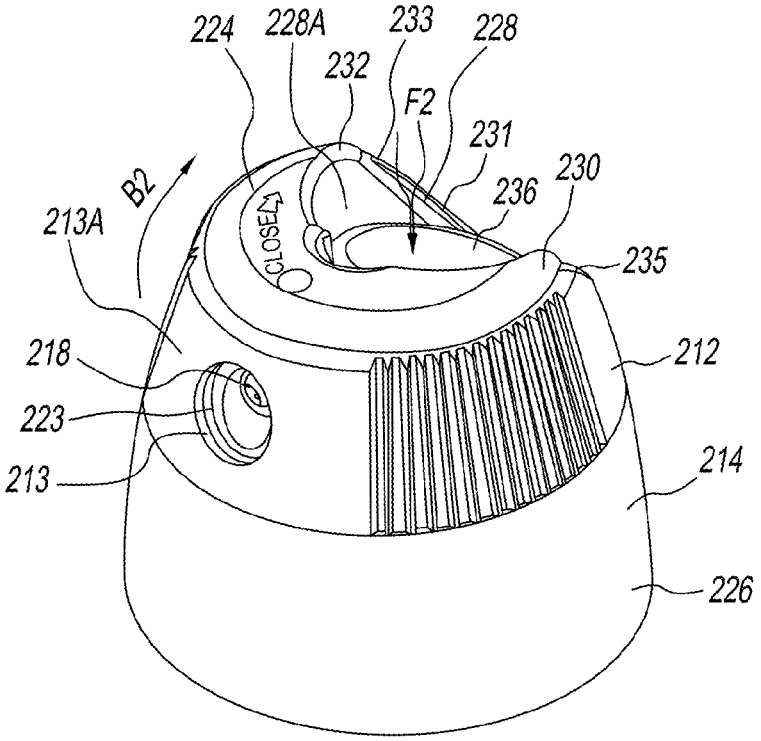
FIG. 32 is a top front perspective view of the dispenser cap of FIG. 27 in the open position and having and the tab removed.
Figure 42:
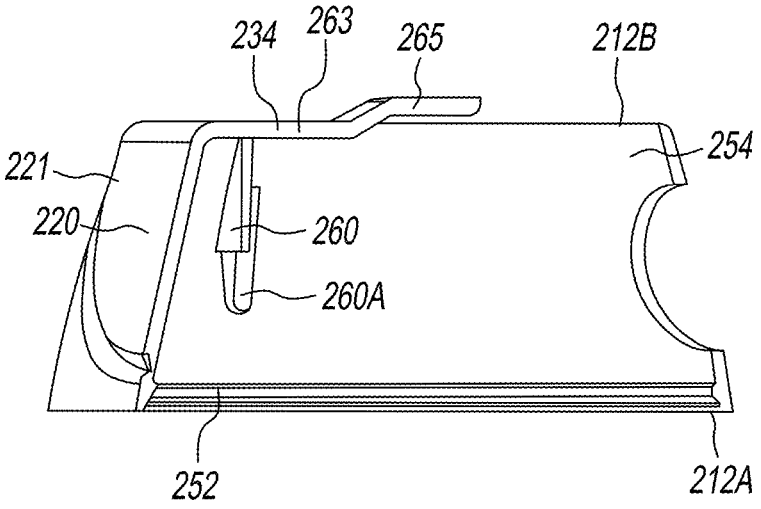
FIG. 42 is a side cross-sectional view of the collar of FIG. 38.

Referring to FIGS. 29 and 31, top tab portion 234 and top shroud portion 224 are sized to minimize or prevent user access to actuator 216 between top tab portion 234 and top shroud portion 224 to minimize or prevent the force, as shown by arrow F2 in FIG. 32, from being applied to actuator 216 thereby preventing the contents of the container connected to dispenser cap 210 from being sprayed. For example, a vertical force of 4.5 pounds is a sufficient force to depress actuator 216. Shroud has two or more protrusions 277 to support the underside of top tab portion 234 and minimize or prevent top tab portion 234 from being depressed. Top shroud portion 224 has a depression 275 that provides a space 276 between top shroud portion 224 and top tab portion 234. Top tab portion 234 has a planar portion 263 that connects to side tab portion 221 and a protruding portion 265 that protrudes away from side tab portion 221 and is a free end of tab 220, as shown in FIG. 42. The user inserts a finger in space 276 to apply a force, for example, as shown by arrow A2, to break connector 222 and remove tab 220 from collar 212. The user may also place a portion of the user's finger under protruding portion 265 of top tab portion 234 while applying the force, for example, as shown by arrow A2, to break connector 222 and remove tab 220 from collar 212. Depression 275 allows a contact portion 236 of actuator 216 to be entirely covered by top tab portion 234 to prevent access to contact portion 236 prior to removal of tab 220.

Figure 33:
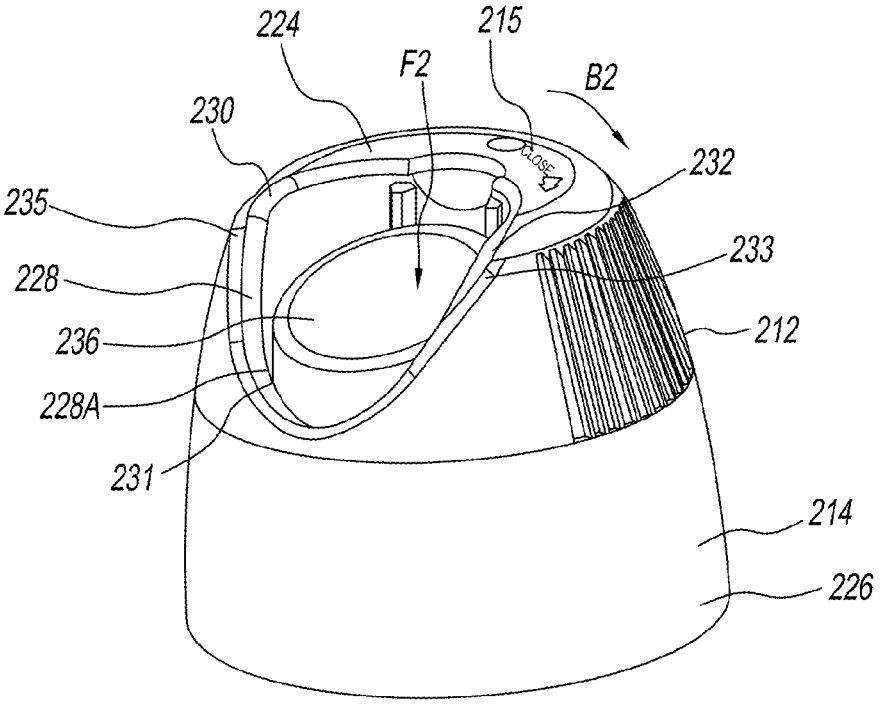
FIG. 33 is a top rear perspective view of the dispenser cap of FIG. 32.
Figure 34:
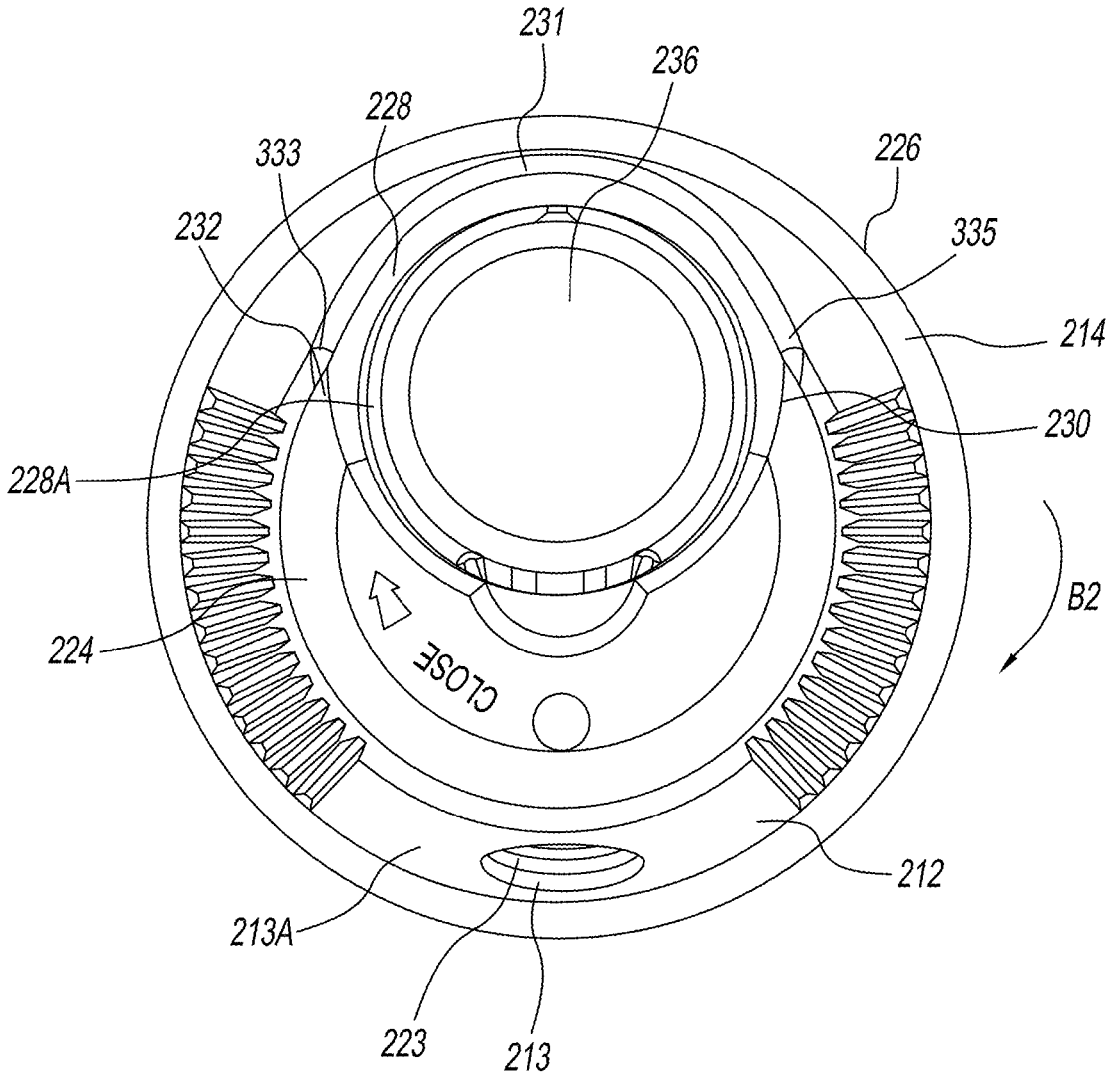
FIG. 34 is a top view of the dispenser cap of FIG. 32.

Referring to FIGS. 32-34, once tab 220 is removed, collar wall 213*a* forms a space 231 between a first collar portion 233 and a second collar portion 235. Space 231 may be U-shaped. Space 231 is aligned with space 228 in shroud 214 so that space 231 and space 228 allow greater access to actuator 216 ("the open position"). Thus, the force, shown by arrow F2 in FIG. 32, can be applied to actuator 216 to dispense the contents of the container connected to dispenser cap 210. For example, a finger of the user can extend through space 231 in collar 212 and space 228 in shroud 214 to contact actuator 216. Once tab 220 is removed, collar 212 can rotate relative to shroud 214, as shown by arrow B2. When dispenser cap 210 is connected to an aerosol container, a user applies a force, as shown by arrow F2 in FIG. 32, to actuator 216 to open a passageway for the product and/or propellant to pass through actuator 216 and insert 218.

Figure 35:
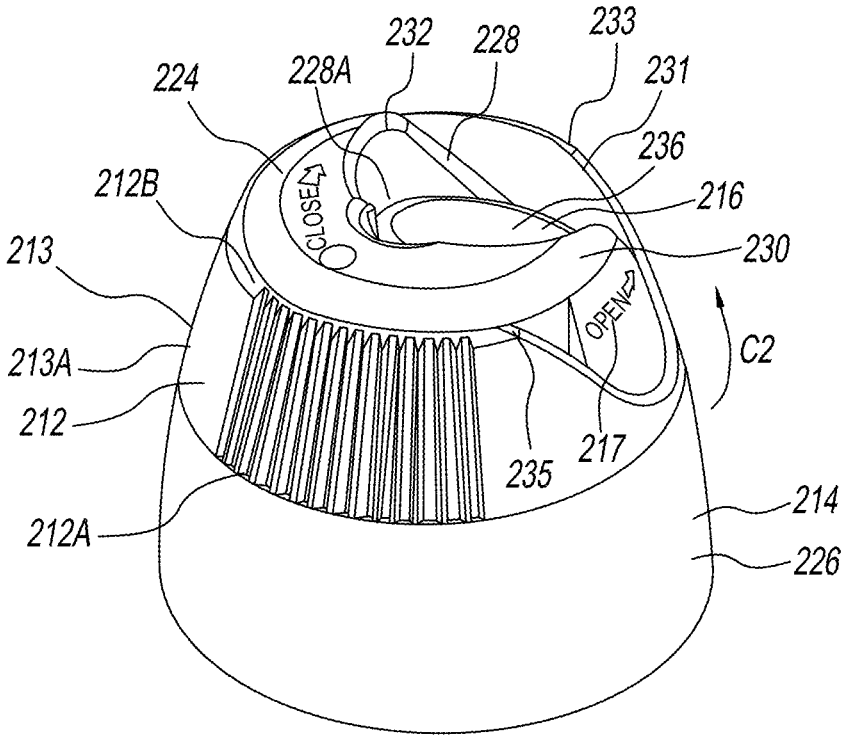
FIG. 35 is a top front perspective view of the dispenser cap of FIG. 27 in a closed position and having the tab removed.
Figure 36:
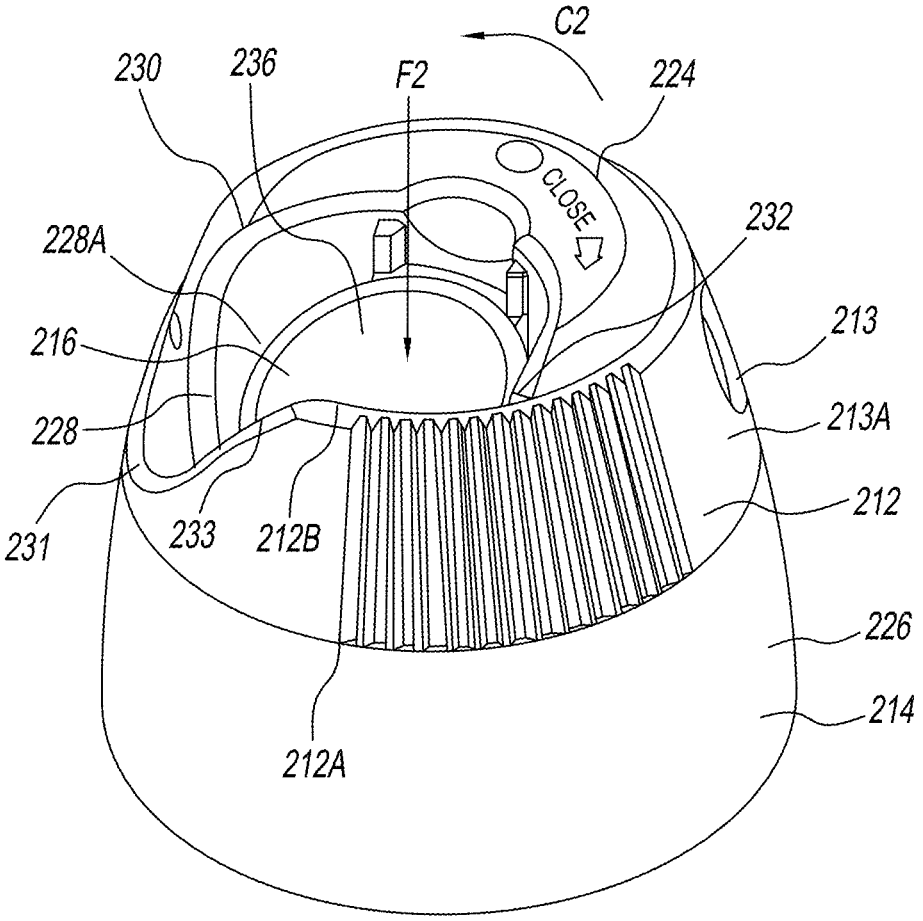
FIG. 36 is a top rear perspective view of the dispenser cap of FIG. 35.
Figure 37:
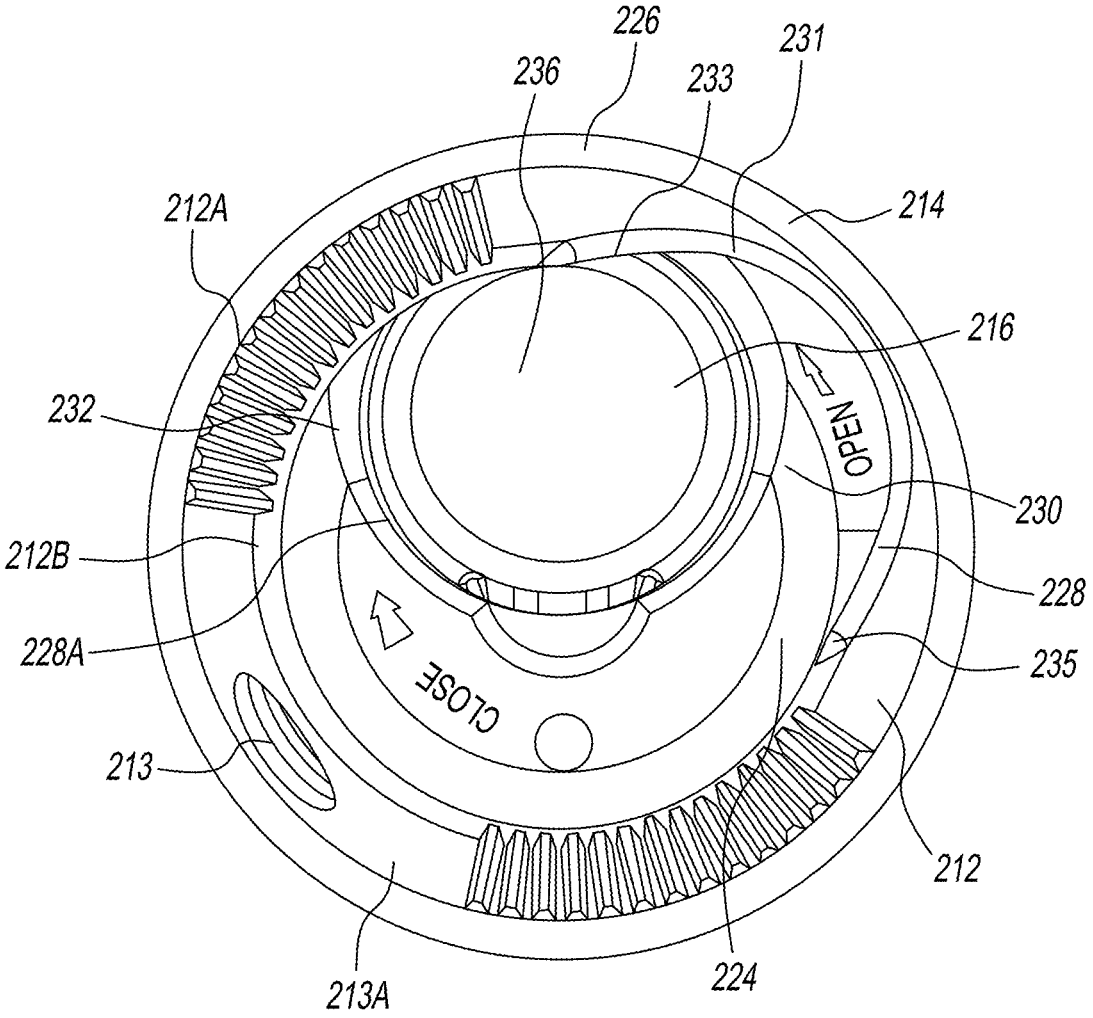
FIG. 37 is a top view of the dispenser cap of FIG. 35.
Figure 38:
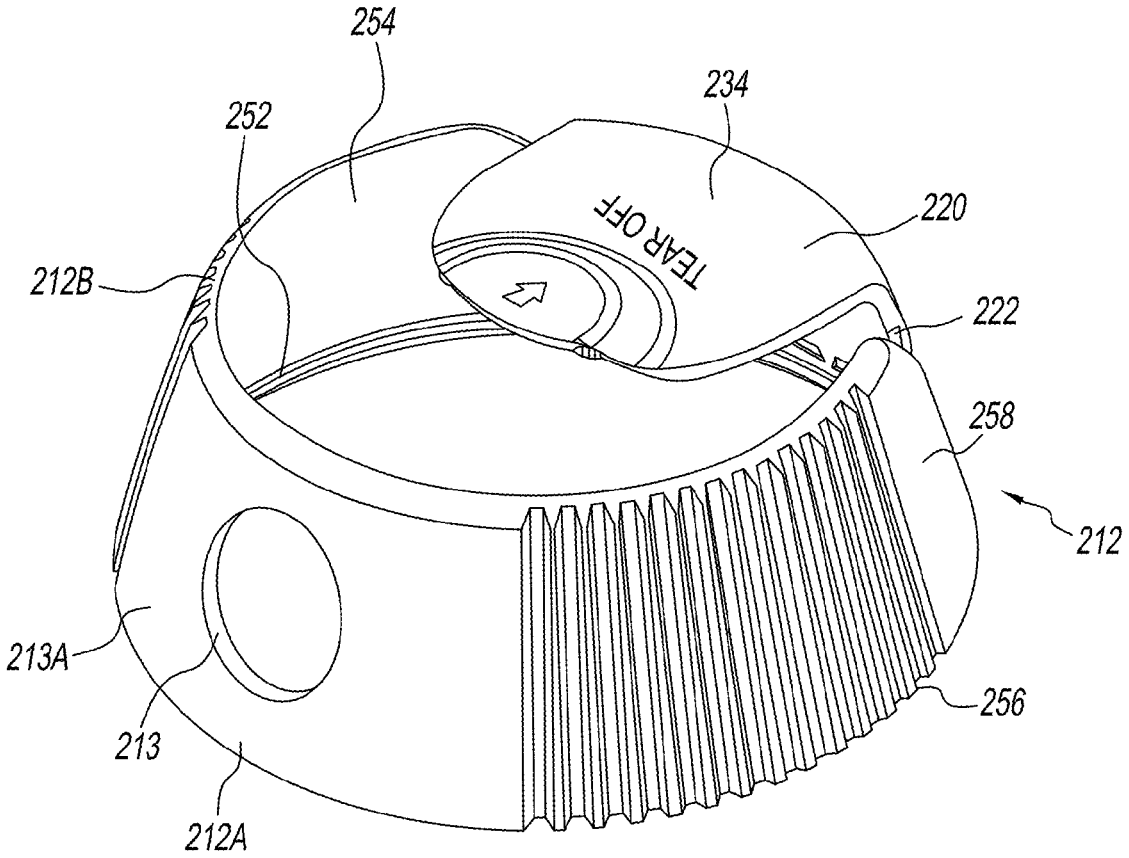
FIG. 38 is a top front perspective view of a collar of the dispenser cap of FIG. 27.
Figure 39:
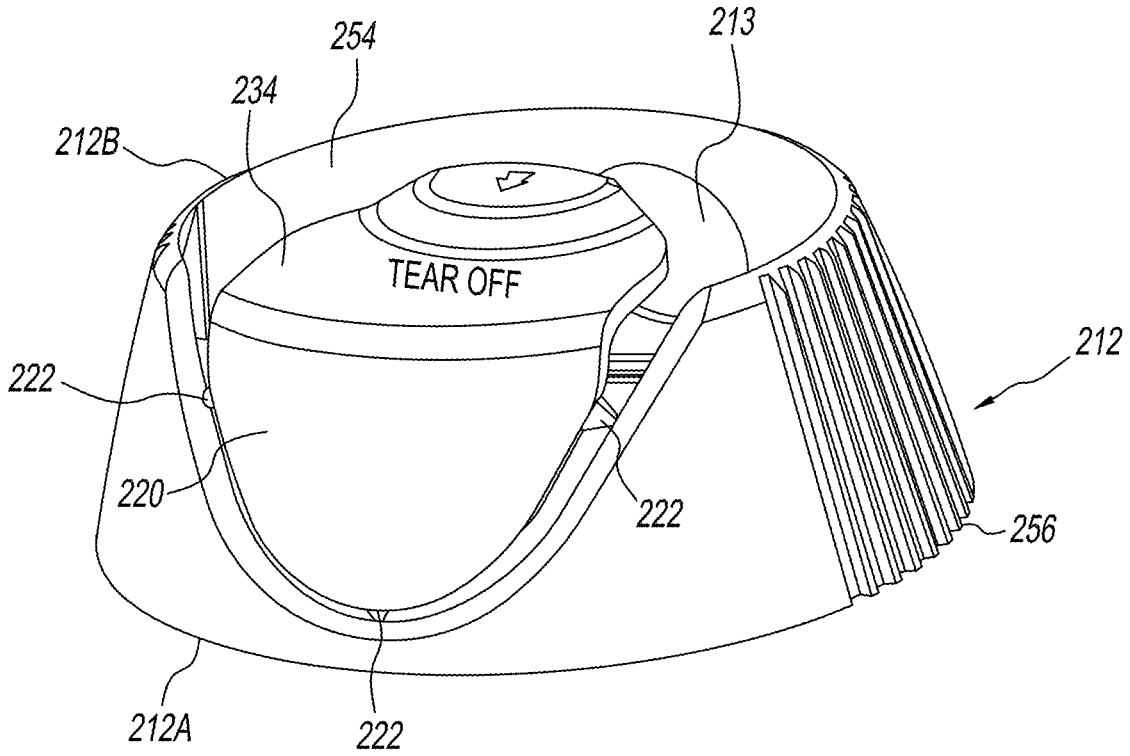
FIG. 39 is a top rear perspective view of the collar of FIG. 38.
Figure 40:
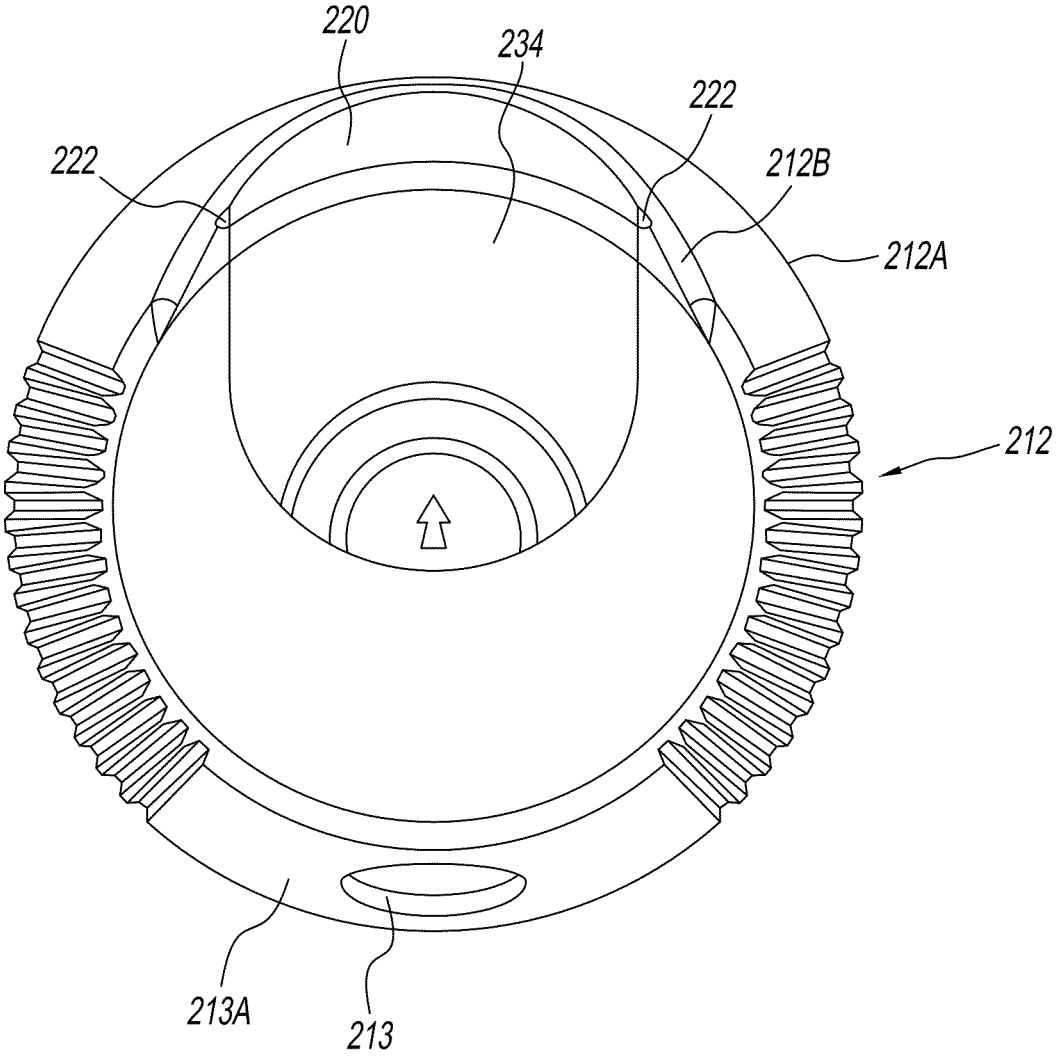
FIG. 40 is a top view of the collar of FIG. 38.

Referring to FIGS. 35-37, dispenser cap 210 has tab 220 (not shown) removed and collar 212 is rotated, as shown by arrow B2 in FIGS. 32-34, thereby moving hole 213 of collar 212 to a position as shown in FIGS. 35-37. In this position, hole 213 of collar 212 and hole 223 of shroud 214 are no longer aligned and collar 212 covers hole 223 of shroud 214. This is the closed position. Space 231 of collar 212 is moved after rotation of collar 212 so that it is no longer aligned with space 228 of shroud 214 in this closed position. A finger of the user can no longer extend through space 231 in collar 212 and space 228 in shroud 214 to contact actuator 216.

Collar 212 has a shape that reduces in size from a bottom edge 212*a* to a top edge 212*b*. Top edge 212*b* of collar 212 covers a portion of space 228 above actuator 216 in the closed position to minimize or prevent the finger of the user from accessing actuator 216 between top edge 212*b* of collar 212 and shroud 214 to apply the force, as shown by arrow F2 in FIG. 36, on actuator 216.

Referring to FIG. 30, actuator 216 is the same as actuator 16 and has a contact portion 236 that is in opening 228*a*. Contact portion 236 is connected to a connection portion 238. A first end 240 of connection portion 238 connects to the container connected to dispenser cap 210, for example, connection portion 238 connects to a tube that receives the propellant and/or product being dispensed from the container. A second end 242 of connection portion 238 is connected to a first end 246 of a conduit 244. First end 246 of conduit 244 also connects to contact portion 236. Conduit 244 has a second end 248 that connects to an insert portion 250.

Insert portion 250 is connected to protrusions 250*a* and 250*b* on opposite sides of insert portion 250. Protrusions 250*a* and 250*b* each fit in one of holders 251 and 253 connected to shroud 214. Holders 251 and 253 are C-shaped so that each has an opening. Protrusions 250*a* and 250*b* and/or holders 251 and 253 may be flexible so that protrusions 250*a* and 250*b* each fit through the opening of one of holders 251 and 253 and are held therein by snap fit. Protrusions 250*a* and 250*b* and holders 251 and 253 form a cantilevered connection between shroud 214 and actuator 216 so that a force, as shown by arrow F2 in FIG. 32, may be applied to contact portion 236 to move contact portion 236 while protrusions 250*a* and 250*b* maintain a connection with holders 251 and 253. Actuator 216 has flexibility so that when the force, as shown by arrow F2 in FIG. 32, is no longer applied to actuator 216, actuator 216 moves in a direction opposite to the force, as shown by arrow F2 in FIG. 32, and returns to its initial position prior to the force being applied.

Insert portion 250 receives insert 218 therein. Conduit 244 connects connection portion 238 to insert portion 250 so that fluid can flow from connection portion 238 through conduit 244, through insert portion 250, and through insert 218 out of dispenser cap 210. As discussed above, the user applies a force, as shown by arrow F2 in FIG. 32, to actuator 216 to open a passageway for the product and/or propellant to pass through actuator 216 and insert 218. Dispenser cap 210 is connected to an aerosol container the same as dispenser cap 10*a*.

Referring to FIGS. 38-42, collar 212 has a protrusion 252 on an interior surface 254 thereof. Protrusion 252 is adjacent bottom edge 212*a*, and is continuous about a perimeter of collar 212. Alternatively, but less preferably, protrusion 252 may be discontinuous. Collar 212 has ridges 256 on an exterior surface 258. Ridges 56 can assist for gripping by the user during rotation of collar 212.

Figure 41:
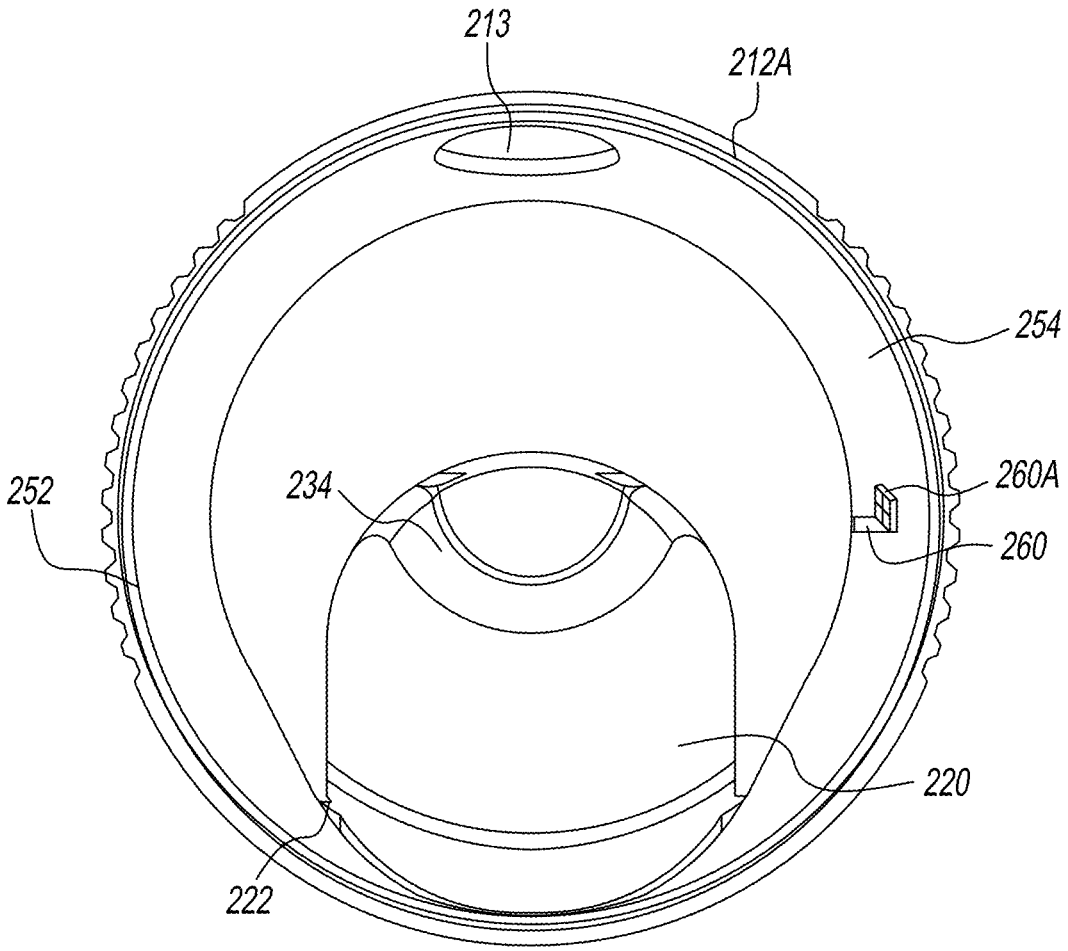
FIG. 41 is a bottom view of the collar of FIG. 38.

Referring to FIGS. 41-42, interior surface 254 has a collar rib 260. Collar rib 260 protrudes from interior surface 254. Collar rib 260 extends in a direction from top edge 212*b* to bottom edge 212*a* of collar 212. Collar rib 260 provides a stop to prevent rotation of collar 212 and stiffens a flexible rib 260*a*. Collar 212 may have collar rib 260 molded on interior surface 254. Flexible rib 260*a* is flexible and deflects during rotation and creates a "click" sound or audible sound.

Figure 43:
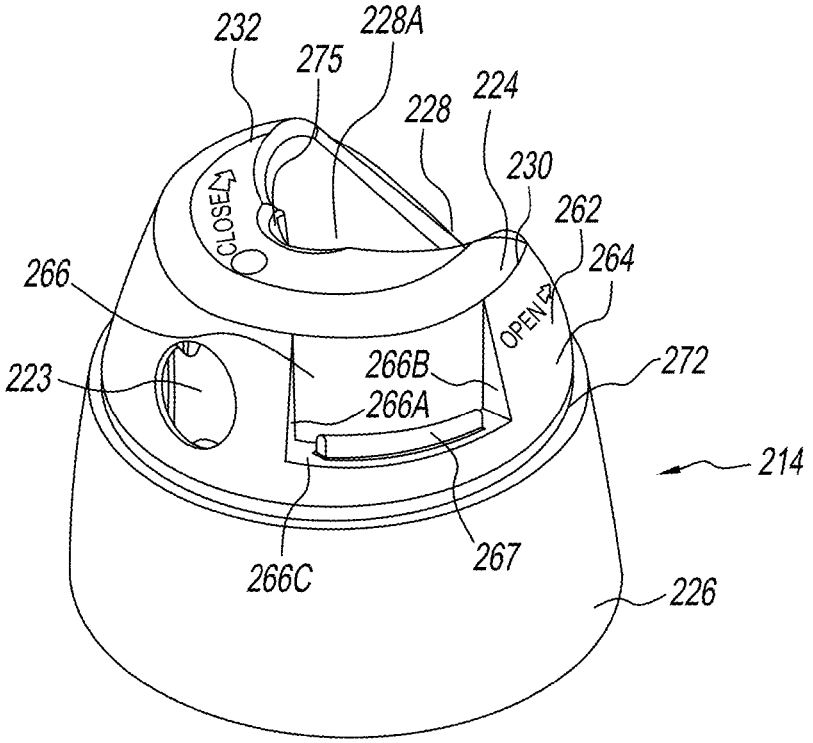
FIG. 43 is a top front perspective view of a shroud of the dispenser cap of FIG. 27.
Figure 44:
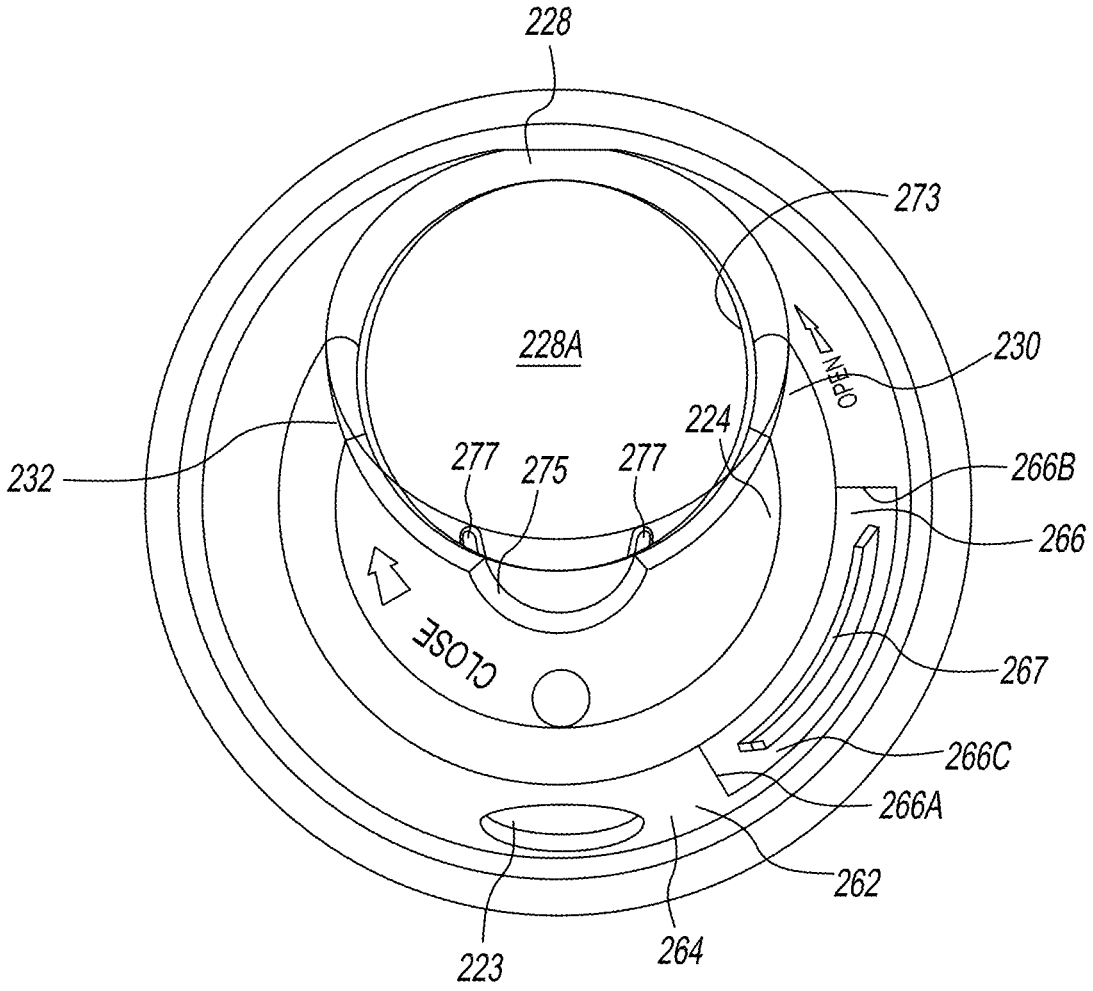
FIG. 44 is a top view of the shroud of FIG. 43.

Referring to FIGS. 43-44, shroud 214 has a middle shroud portion 262 between top shroud portion 224 and bottom shroud portion 226. Middle shroud portion 262 has an outer surface 264 that forms a depression 266. Depression 266 has a first side wall 266*a*, a second side wall 266*b* and a bottom wall 266*c* between first side wall 266*a* and second side wall 266*b*. Middle shroud portion 262 has a post 267 that is a single rib in depression 266. Post 267 may be rigid. Post 267 may be molded in depression 266. Outer surface 264 of middle shroud portion 262 forms a groove 272. Groove 272 is adjacent to bottom shroud portion 226. Groove 272 is sized and shaped to receive protrusion 252 of collar 212.

Referring to FIG. 44, shroud 214 has an inner wall 273 that surrounds opening 228*a*. Inner wall 273 has protrusions 277. Protrusions 277 provide support to top tab portion 234 when tab 220 is in the connected position. Protrusions 277 increase resistance of top tab portion 234 to deflection under load, and, in particular, increases a top load strength of top tab portion 234.

Referring to FIG. 31, collar 212 is connected to shroud 214 by positioning protrusion 252 of collar 212 in groove 272 of shroud 214. This connection can be, for example, a snap fit. Groove 272 and protrusion 252 allow for rotation of collar 212 relative to shroud 214. Groove 272 and protrusion 252 maintain collar 212 connected to shroud 214. Collar 212 and shroud 214 include erucamide slip additive, for example, 4 grams per kilogram of polypropylene that achieves ease of rotation of collar 212 while not affecting the retention of collar 212 on shroud 214.

Figure 45:
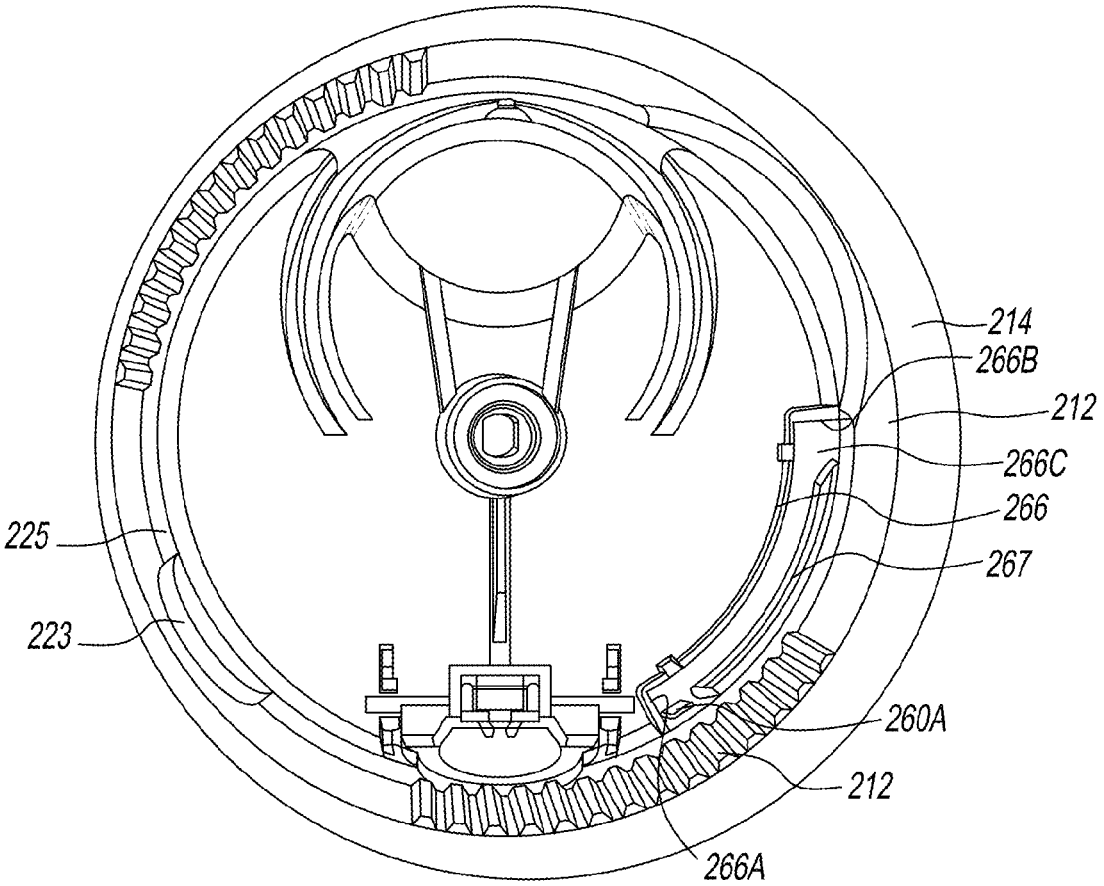
FIG. 45 is a top cross-sectional view of the dispenser cap of FIG. 35.
Figure 46:
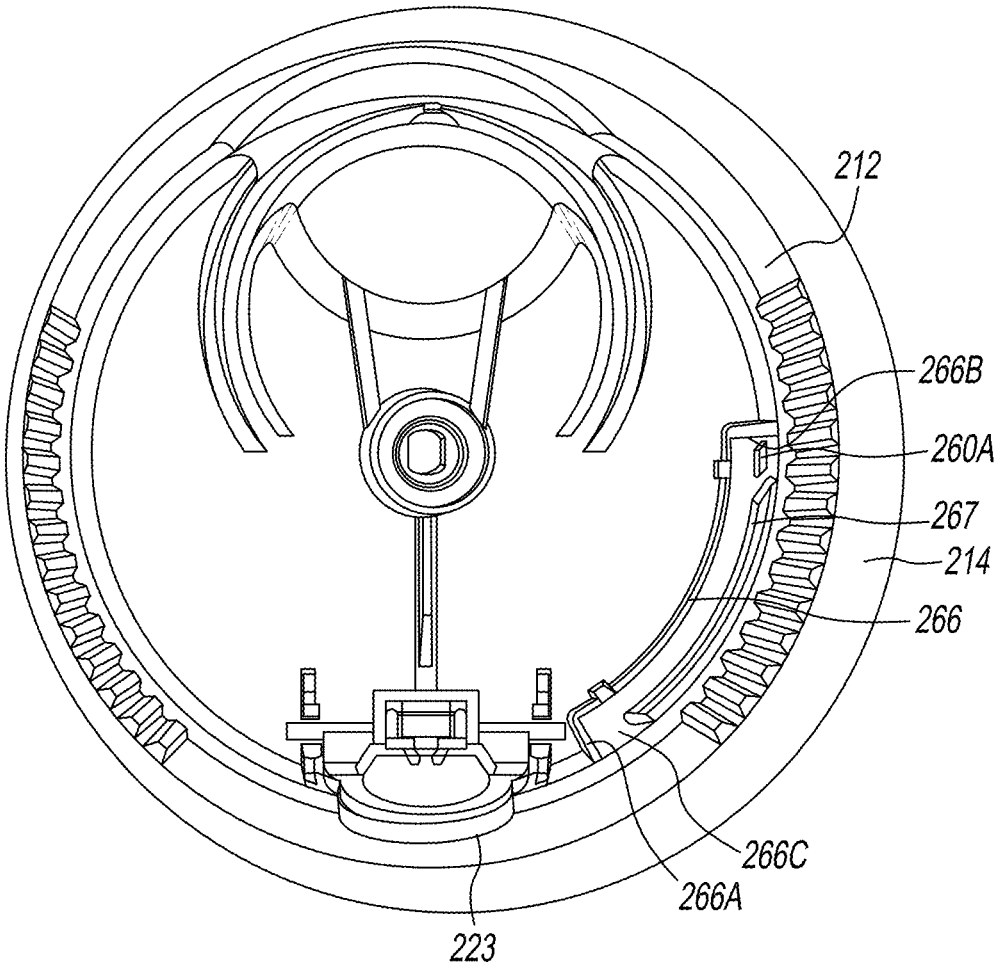
FIG. 46 is a top cross-sectional view of the dispenser cap of FIG. 32.
Figure 47:
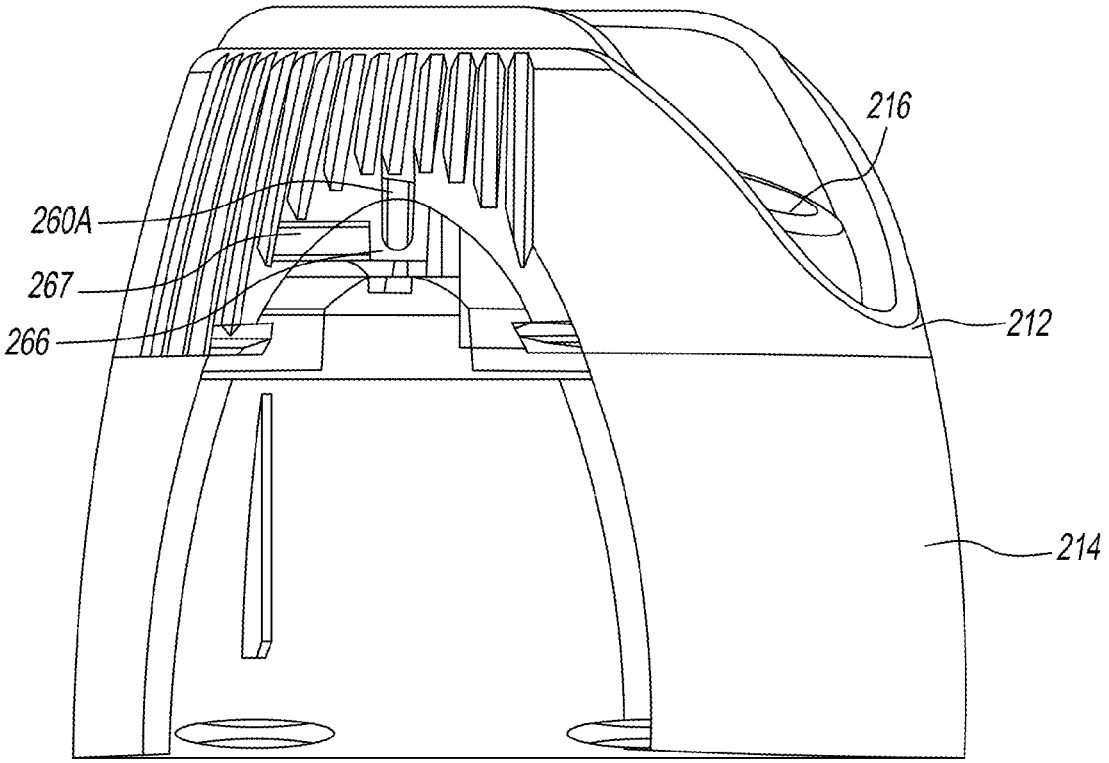
FIG. 47 is a right side view of the dispenser cap of FIG. 32 with a portion of the collar and shroud cut away in the open position.

Referring to FIGS. 45-47, collar 212 is connected to shroud 214 so that flexible rib 260*a* extends into depression 266 formed by outer surface 264 of shroud 214. Flexible rib 260*a* extends into depression 266 so that during rotation a portion of flexible rib 260*a* contacts post 267 deforming flexible rib 260*a* and/or collar 212 allowing flexible rib 260*a* to pass around post 267. Flexible rib 260*a* may be made of material, for example, homo-polymer polypropylene. The contact between flexible rib 260*a* and post 267 generates an audible noise or "click".

Referring to FIG. 46, when tab 220 is in the connected position, dispenser cap 210 is in the open position. When dispenser cap 210 is in the open position, flexible rib 260*a* is between post 267 and second sidewall 266*b* of depression 266 formed in shroud 214. Top tab portion 234 and top shroud portion 224 are sized to minimize or prevent user access to actuator 216 between top tab portion 234 and top shroud portion 224 to thereby minimize or prevent the force, as shown by arrow F2, from being applied to contact portion 236 of actuator 216 that would dispense the contents of the container connected to dispenser cap 210 when tab 220 is connected. The user grasps tab 220 by inserting a finger in space 276 and applies the force, for example, as shown by arrow A2, to break connectors 222 and remove tab 220 from collar 212.

As shown in FIG. 29, tab 220 has an indicator 234*a* indicating to a user a direction to apply a force to tab 220 to remove tab 220, for example, "TEAR OFF" with an arrow in the direction A2 is molded into tab portion 234.

Referring back to FIG. 33, once tab 220 is removed, the finger of the user can extend through space 231 in collar 212 and space 228 in shroud 214 to contact actuator 216 to apply the force, as shown by arrow F2, to spray the contents of the container connected to dispenser cap 210. Dispenser cap 210 is maintained in the open position until a predetermined force is applied sufficient to move flexible rib 260*a* to pass around post 267.

Once tab 220 is removed, collar 212 can rotate relative to shroud 214, as shown by arrow B2, by application of a predetermined force. Shroud 214 has an indicator 215 to indicate to a user a direction to rotate collar 212 to move to the closed position, for example, "CLOSE" with an arrow is molded into top shroud portion 224. As collar 212 is rotated, for example, about 60 degrees, flexible rib 260*a* passes around post 267 to move to the closed position, as shown in FIGS. 35-37. The contact between flexible rib 260*a* and post 267 generates an audible noise or "click". Flexible rib 260*a* interacts with post 267 by creating a single pronounced clicking positional-indicating noise each time the rotation of collar 212 in either direction moves flexible rib 260*a* past post 267. As shown in FIG. 45, in the closed position, flexible rib 260*a* is between post 267 and first sidewall 266*a* of depression 266. Dispenser cap 10 is maintained in the closed position until a predetermined force is applied sufficient to move flexible rib 260*a* to pass around post 267. Top edge 212*b* of collar 212 covers a portion of contact portion 236 and space 231 of collar 212 is moved after rotation of collar 212 so that it is no longer aligned with space 228 of shroud 214 in the closed position. Access to actuator 216 is prevented or minimized in the closed position so that the user cannot apply the force, shown by arrow F2, to dispense the contents of the container as collar 212 blocks access to actuator 216 and covers or hides hole 223 in shroud 214. However, contact portion 236 is movable in the closed position. Collar wall 213*a* may contact shroud wall 225 surrounding hole 223 in the closed position.

Collar 212 can rotate relative to shroud 214, as shown by arrow C2 in FIG. 35-36. As collar 212 is rotated, for example, about 60 degrees, flexible rib 260*a* passes around post to move to the open position, as shown in FIG. 32. As shown in FIG. 35, shroud 214 has an indicator 217 for indicating to a user a direction to rotate collar 212 to move to the open position, for example, "OPEN" with an arrow is molded into middle shroud portion 262. The contact between flexible rib 260*a* and post 267 generates an audible noise or "click". Flexible rib 260*a* interacts with post 267 by creating a single pronounced clicking positional-indicating noise when flexible rib 260*a* passes post 267. Once tab 220 is removed, dispenser cap 210 can selectively move to and from the open and closed positions as the user desires. Flexible rib 260*a* rotates between first side wall 266*a* and second side wall 266*b* of depression 266 so that first side wall 266*a* and second side wall 266*b* restrict rotation of flexible rib 260*a* and collar 212.

Figure 48:
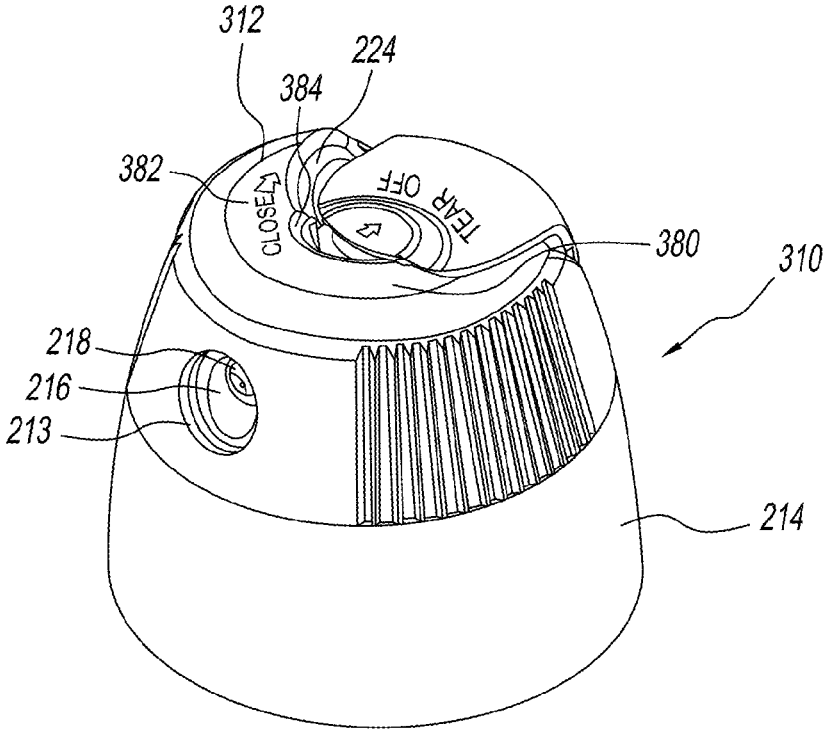
FIG. 48 is a top front perspective view of a third exemplary embodiment of a dispenser cap in an open position and having a tab in a connected position.
Figure 49:
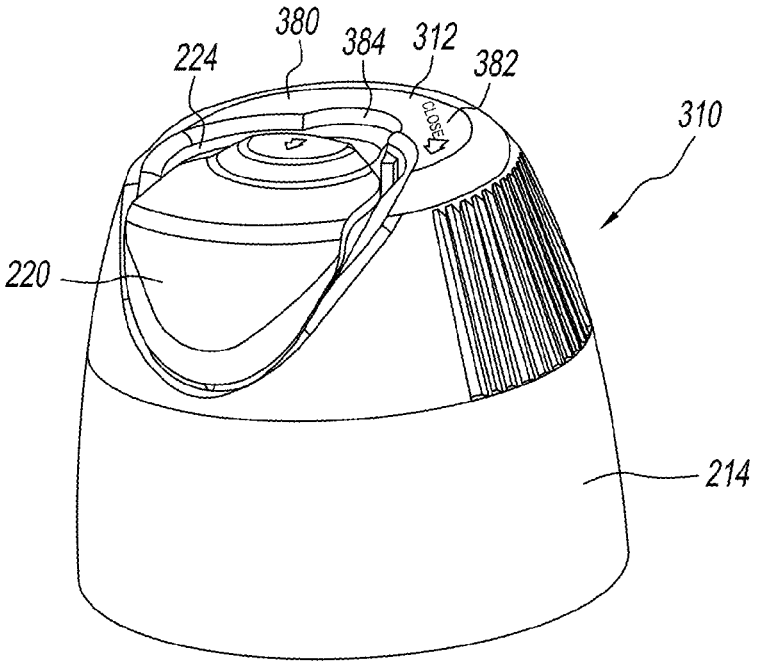
FIG. 49 is a top rear perspective view of the dispenser cap of FIG. 48.
Figure 50:
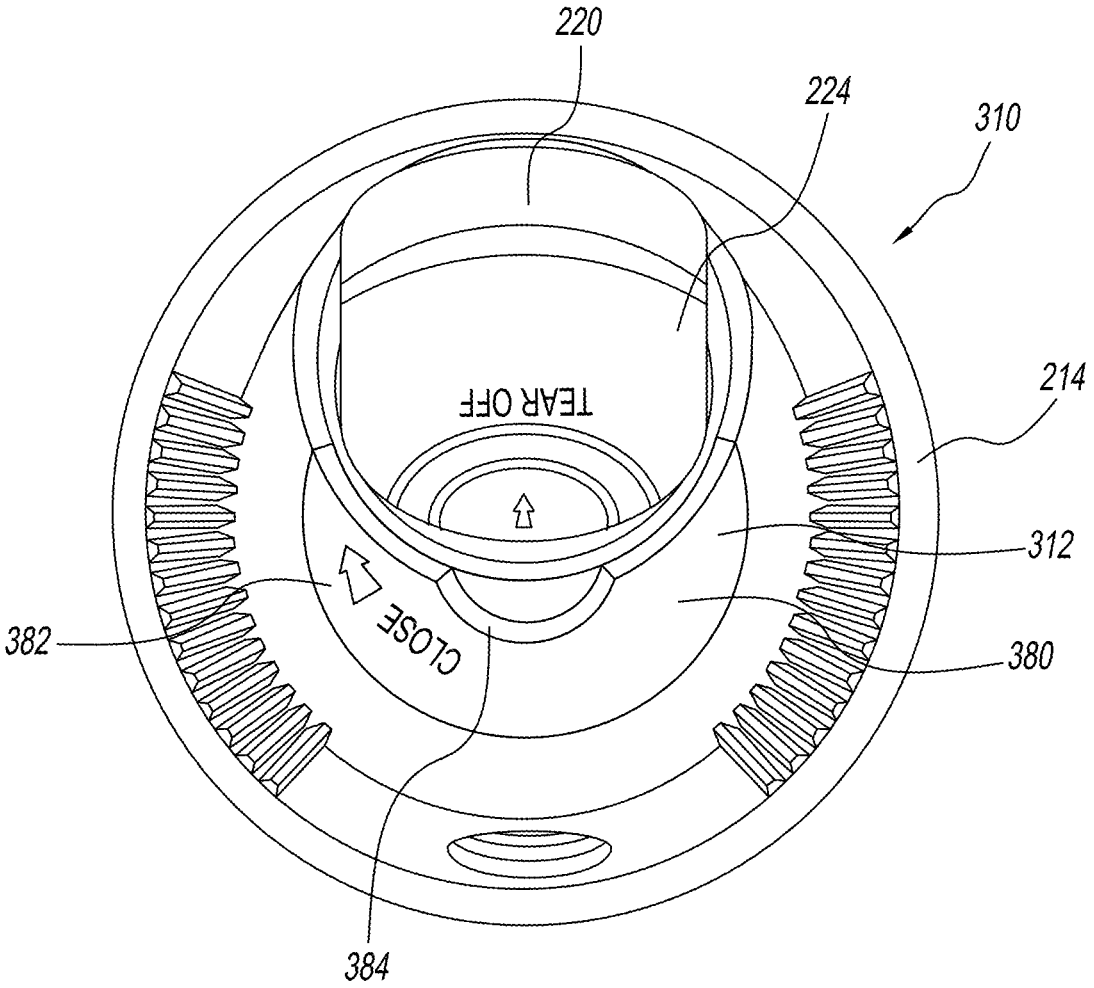
FIG. 50 is a top view of the dispenser cap of FIG. 48.
Figure 51:
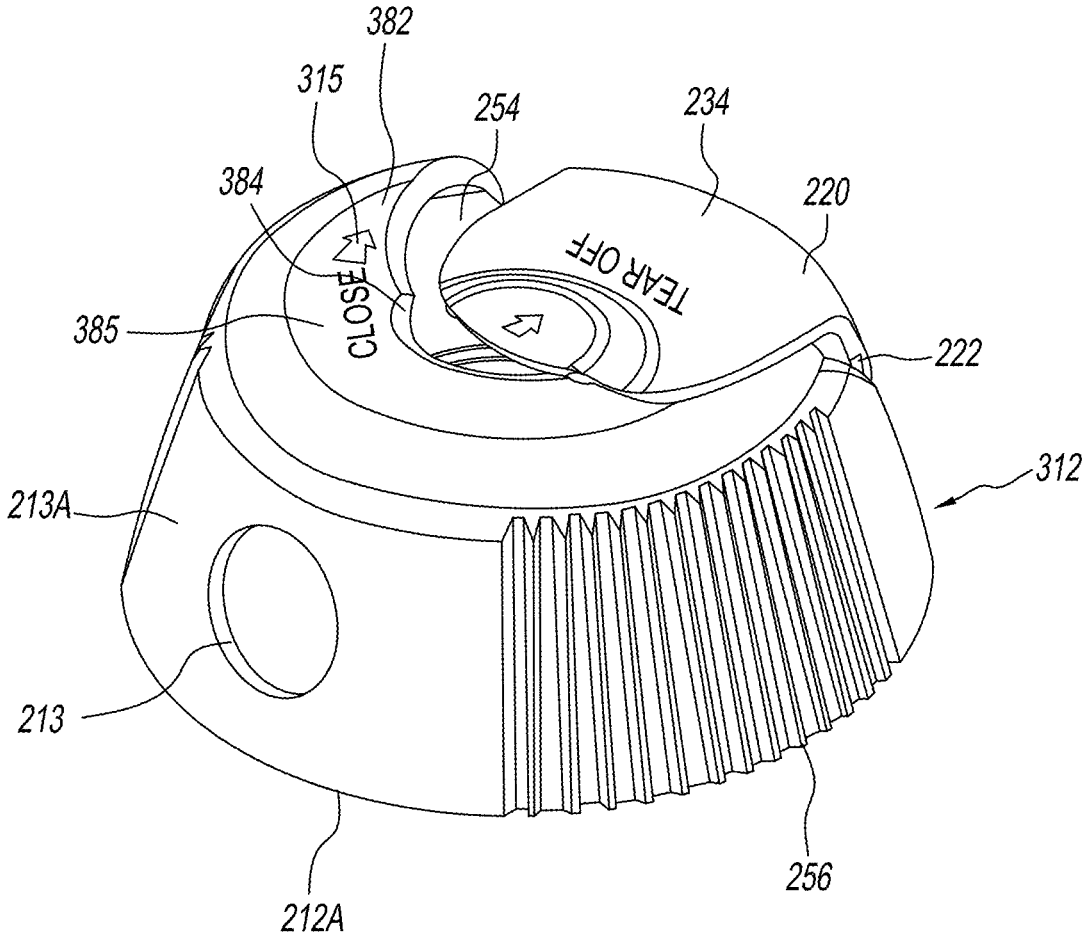
FIG. 51 is a top front perspective view of a collar of the dispenser cap of FIG. 48.
Figure 52:
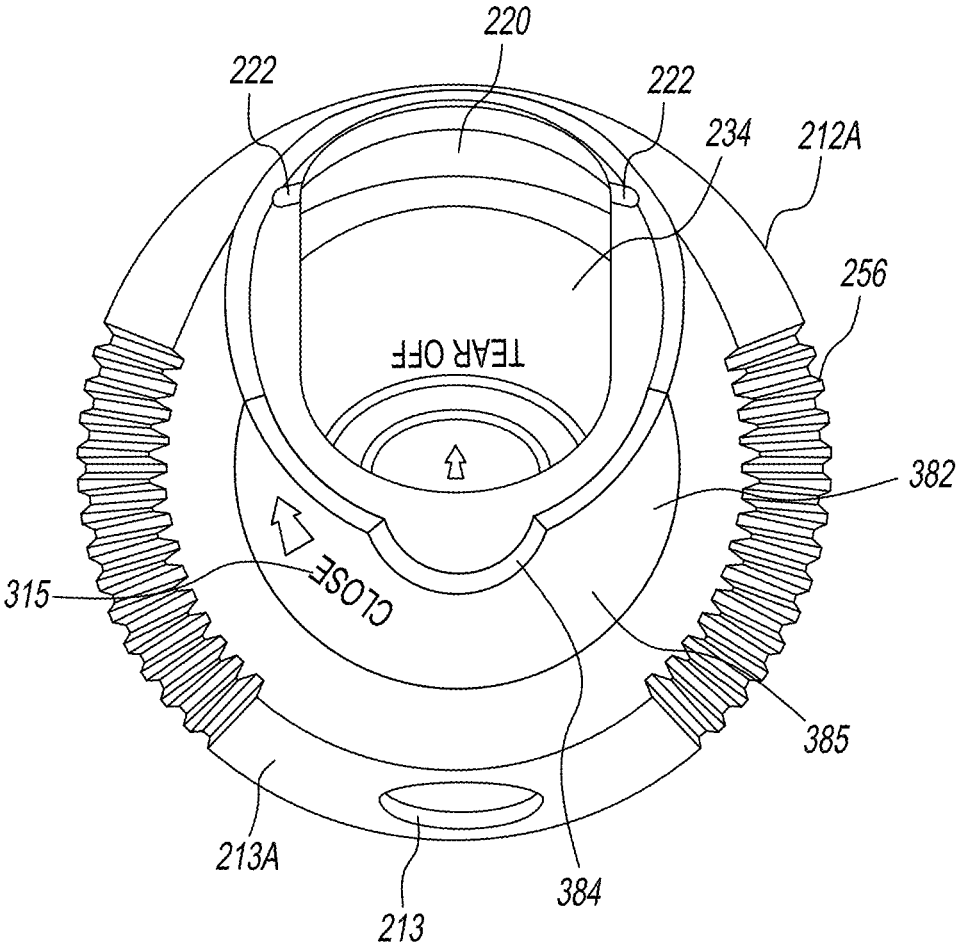
FIG. 52 is a top view of the collar of FIG. 51.
Figure 53:
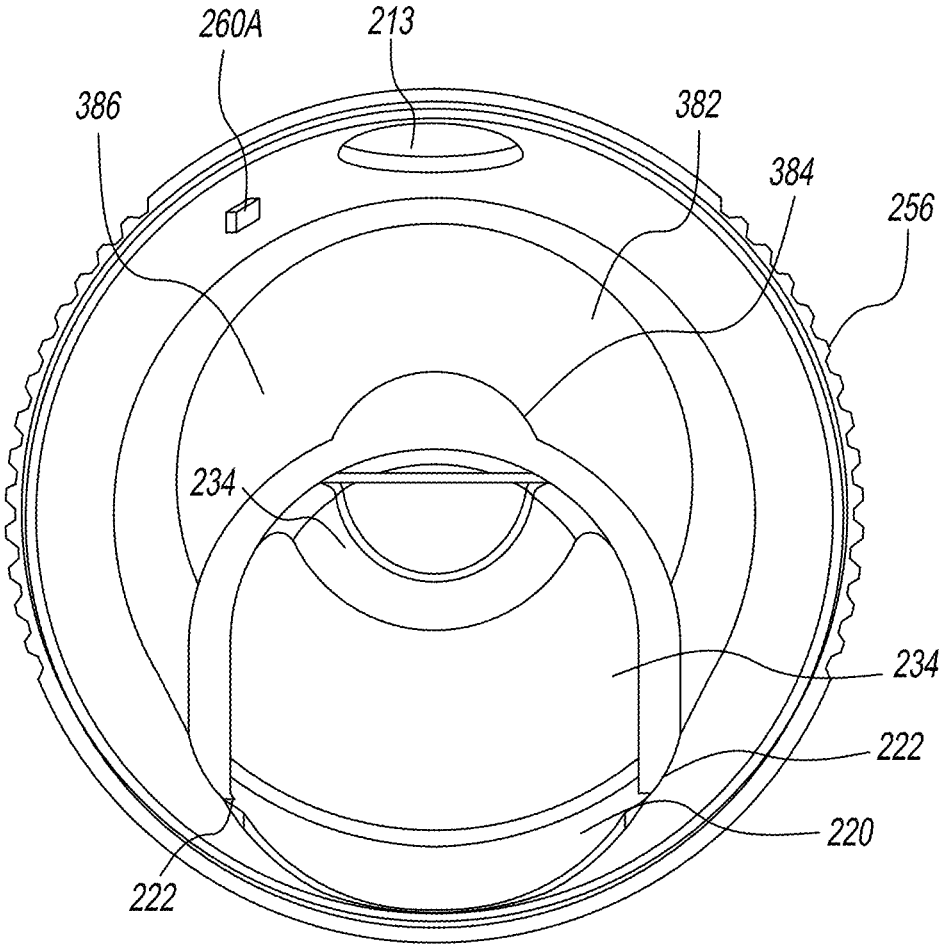
FIG. 53 is a bottom view of the collar of FIG. 51.
Figure 54:
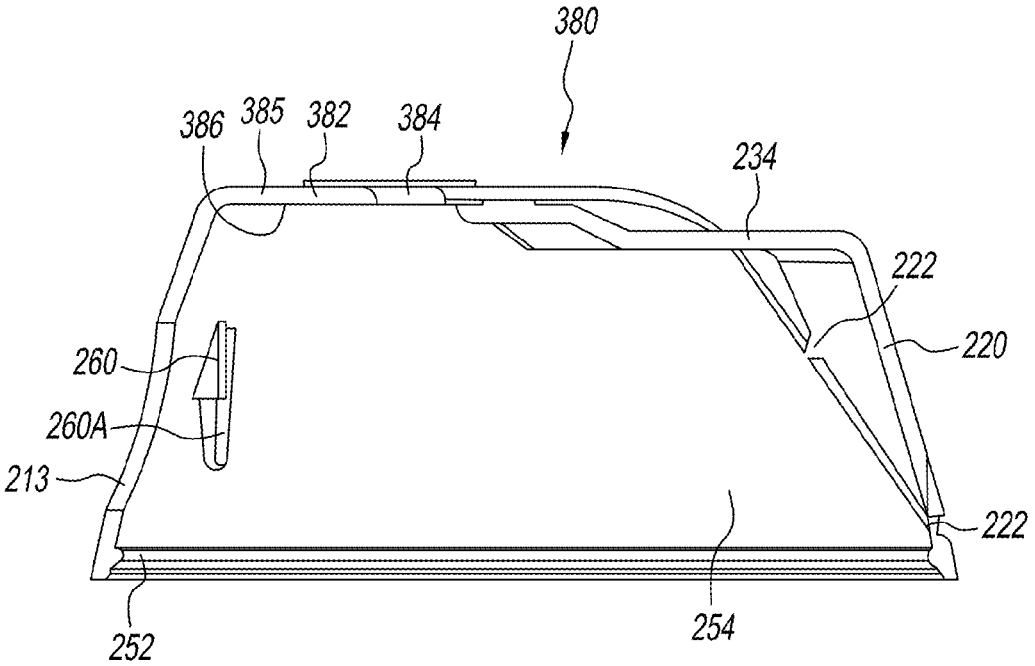
FIG. 54 is a side cross-sectional view of the collar of FIG. 51.
Figure 55:
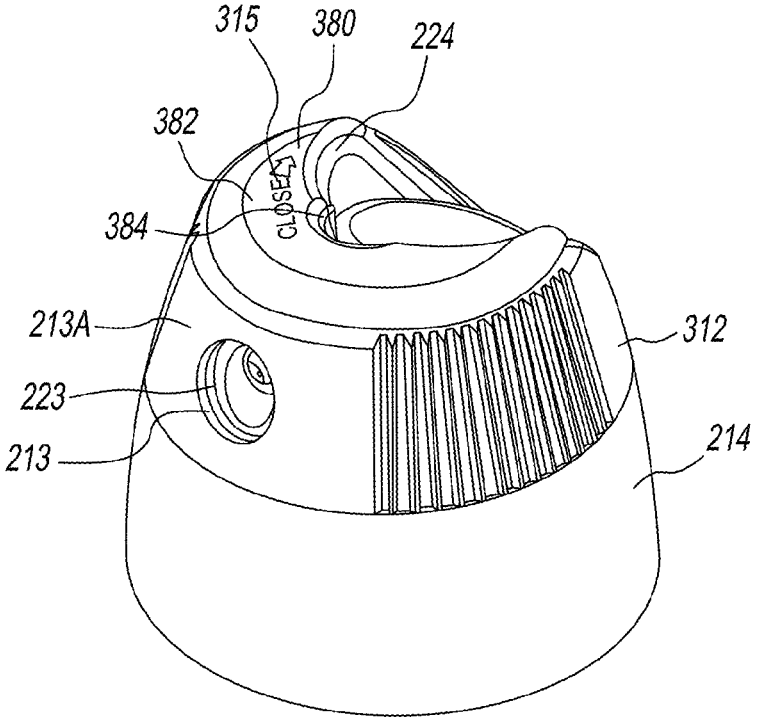
FIG. 55 is a top front perspective view of the dispenser cap of FIG. 48 in an open position and having the tab removed.
Figure 56:
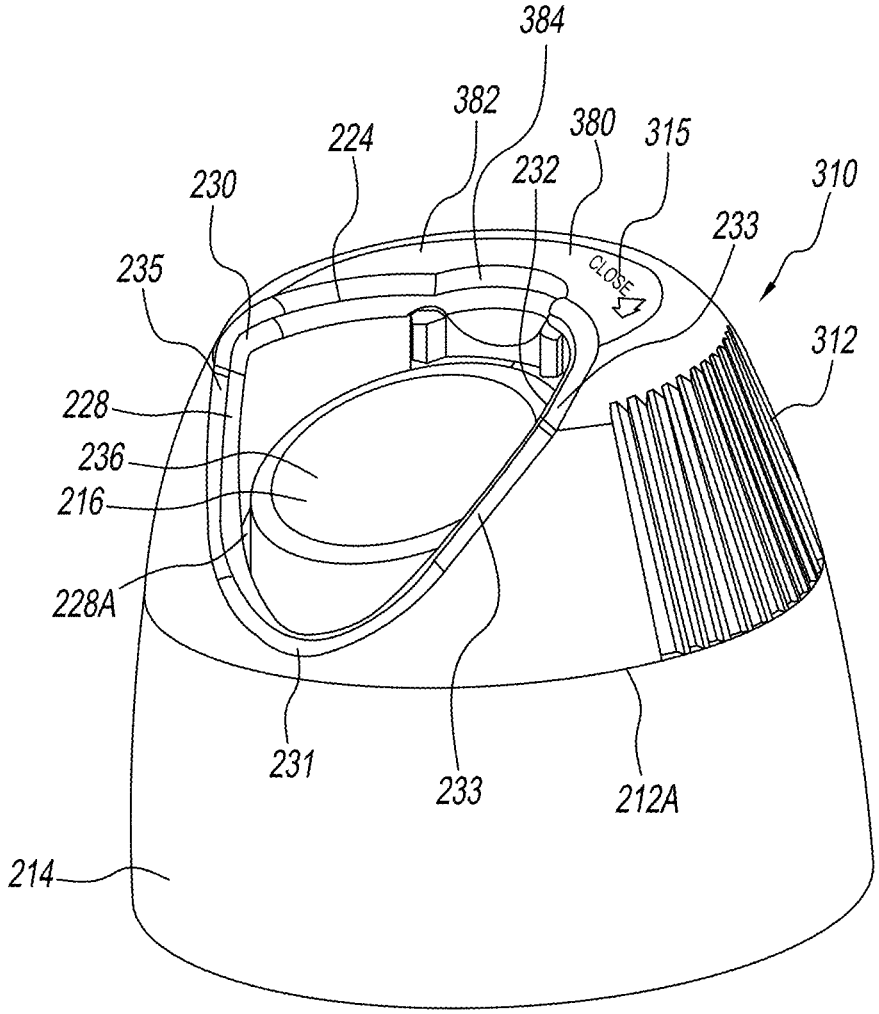
FIG. 56 is a top rear perspective view of the dispenser cap of FIG. 55.
Figure 57:
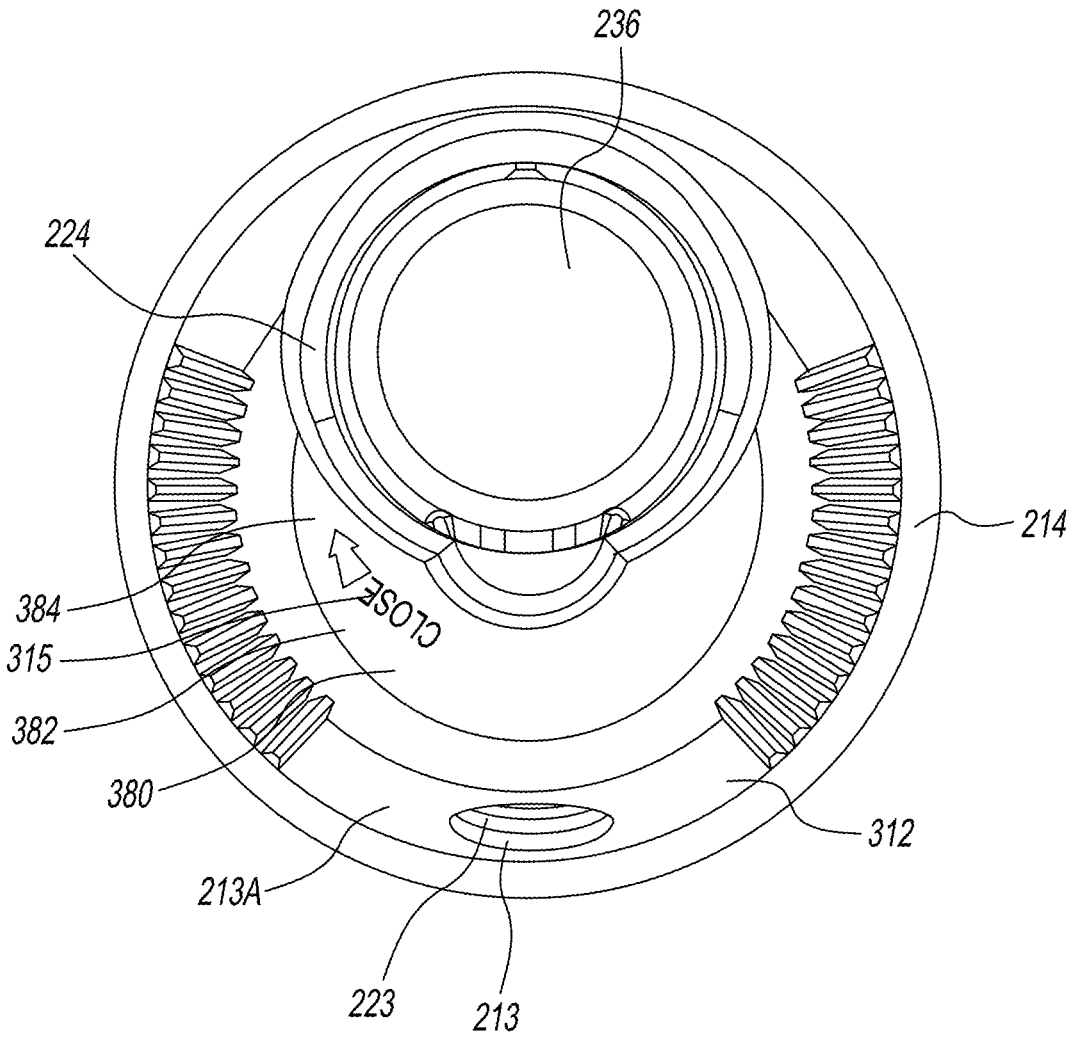
FIG. 57 is a top view of the dispenser cap of FIG. 55.

Referring to FIGS. 48-50, a third exemplary embodiment of a dispenser cap according to the present disclosure is shown in an opened position and is generally referred to by reference numeral 310. Dispenser cap 310 is the same as dispenser cap 210, however, dispenser cap 310 has a collar 312 that is different than collar 212. Collar 312 is the same as collar 212 except collar 312 has a top collar portion 380 instead of top edge 212*b*. Accordingly, the same reference numerals from dispenser cap 210 will be used for dispenser cap 310 for the same features.

Top collar portion 380 has a wall 382. Wall 382 of top collar portion has a depression 384. Wall 382 and depression 384 of top collar portion 380 have a complementary shape to top shroud portion 224.

Referring to FIGS. 51-54, wall 382 of top collar portion 380 has an outer surface 385 and inner surface 386. Outer surface 385 of top collar portion has an indicator 315 to indicate to a user a direction to rotate collar 312 to move to the closed position, for example, "CLOSE" with an arrow is molded into top collar portion 380.

As shown in FIGS. 48-50 and 55-57, top collar portion 380 covers top shroud portion 224 in the open position.

Figure 58:
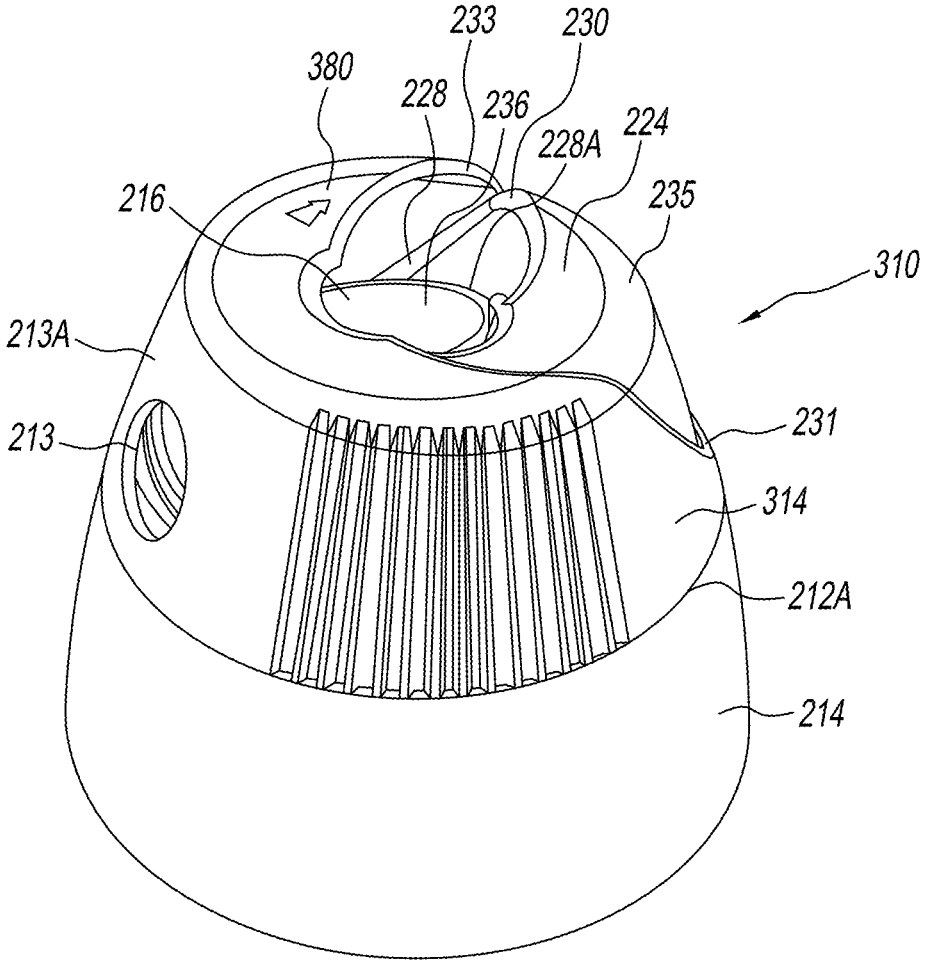
FIG. 58 is a top front perspective view of the dispenser cap of FIG. 48 in a closed position and having the tab removed.
Figure 59:
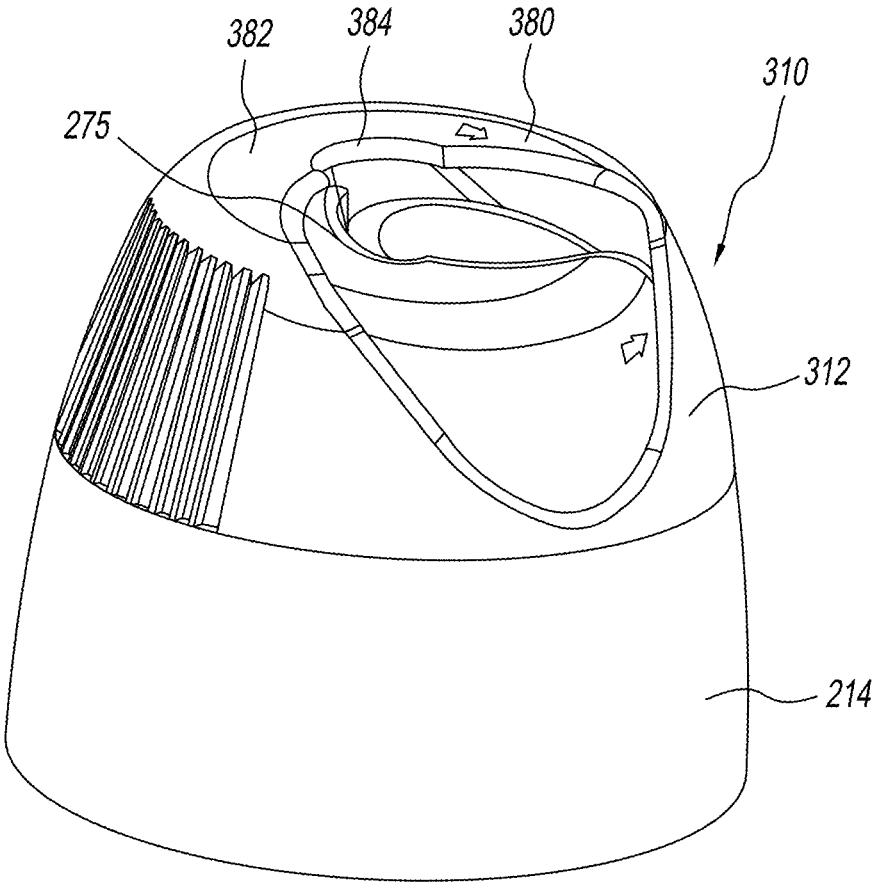
FIG. 59 is a top rear perspective view of the dispenser cap of FIG. 58.
Figure 60:
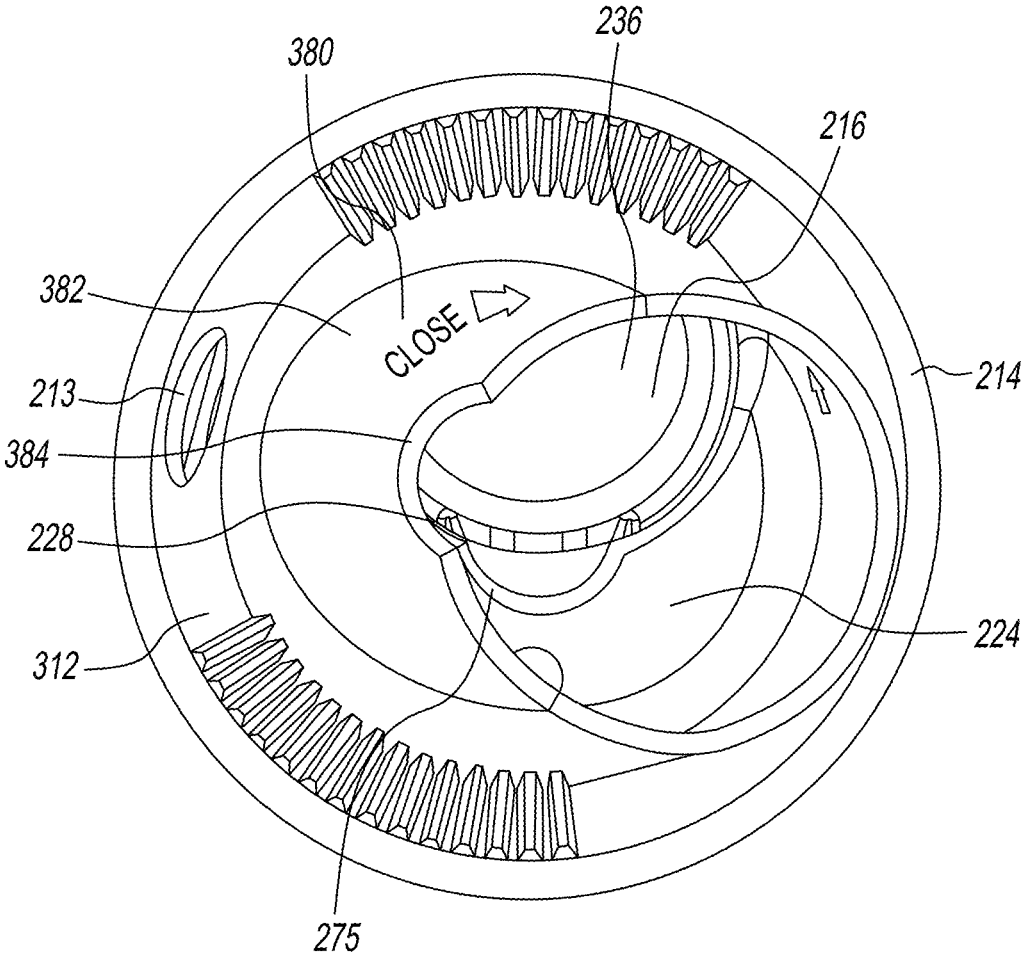
FIG. 60 is a top view of the dispenser cap of FIG. 58.

As shown in FIGS. 58-60, top collar portion 380 covers a portion of space 228 above actuator 216 in the closed position to minimize or prevent the finger of the user from accessing actuator 216 between top collar portion 380 and shroud 214 to apply the force, as shown by arrow F2 in FIG. 36, on actuator 216. Hole 213 is positioned over recess 266 in the closed position.

A dispenser assembly including caps 210 and 310 reduces build-up of gel on dispenser caps 210 and 310 in contrast to FIG. 25, or any build-up of gel is hidden from view by collars 212 and 312 covering hole 223 in shroud 214. Advantageously, dispenser caps 210 and 310 minimize or prevent undesirable build-up as well as minimize or prevent dispensing of contents of a container connected to dispenser caps 210 and 310 by obstructing access to actuator 216 in the closed position or prior to use.

Dispenser caps 10, 210 and 310 deter in store spraying by consumers or users by tabs 20 and 220. Dispenser caps 10, 210 and 310 prevent unintentional actuation by users by tabs 20 and 220 as well as collars 12, 212 and 312 blocking access to actuator 16 and 216 and covering or hiding hole 23 and 223 in shroud 14 and 214.

Dispenser cap 10 has actuator 16 and dispenser caps 210 and 310 have actuator 216 that is moveable in both the open position and the closed position. This feature allows use of existing actuators with these dispenser caps. Further, dispenser caps 10, 210 and 310 do not require mechanisms to prevent movement of actuators 16 and 216, respectively, increasing ease of manufacture and assembly of these dispenser caps over prior art dispenser caps that prevent movement of actuators in a non-use position. Enhanced ergonomics are also provided by the position of actuator 16 being recessed in shroud 14 and actuator 216 being recessed in shroud 214. If a user does not wish to exert the effort to move collars 12, 212 and 312, actuators 16 and 216 may always be depressed.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cap for a container that stores and dispenses fluids or gels comprising:

a shroud having a shroud wall surrounding an opening;

a collar connected on the shroud so that the collar selectively rotates relative to the shroud in a first direction and a second direction opposite the first direction, the collar being rotatable between a closed position and an open position, the collar having rotation restricted in the first direction in the open position and the collar having rotation restricted in the second direction in the closed position; and an actuator being connected to the shroud and having a contact portion, the contact portion being in the opening of the shroud, the actuator being movable in both the closed position and the open position by a force that is applied to the contact portion, and at least a portion of the actuator being uncovered by the cover in the closed position and in the open position.

2. The cap of claim 1, wherein the collar has a top edge opposite a bottom edge, and wherein the collar is reduced in size from the bottom edge to the top edge.

3. The cap of claim 2, wherein the shroud wall partially surrounds the contact portion.

4. The cap of claim 3, wherein the top edge of the collar covers a portion of the contact portion in the closed position.

5. The cap of claim 4, wherein the top edge of the collar uncovers a portion of the contact portion in the open position.

6. The cap of claim 1, wherein the shroud wall has an outer surface that forms a depression with at least a first shroud rib in the depression.

7. The cap of claim 6, wherein the collar s an interior surface with a collar rib that protrudes from the interior surface.

8. The cap of claim 7, wherein the collar is connected to the shroud so that the collar rib extends into the depression formed by the outer surface of the shroud, and wherein the collar rib extends into the depression so that during rotation of the collar a portion of the collar rib contacts the first shroud rib deforming the collar rib and/or the collar so that the collar rib passes around the first shroud rib.

9. The cap of claim 8, wherein the contact between the collar rib and the first shroud rib generates an audible noise.

10. The cap of claim 1, wherein the collar has a collar wall that form collar space between a first collar portion and a second collar portion.

11. The cap of claim 10, wherein the shroud has a shape that forms a shroud space between a first side portion and a second side portion, and wherein the collar space is aligned with the shroud space in the open position and at least a portion of collar wall covers at least a portion of the shroud space in the closed position.

12. The cap of claim 11, wherein the collar is connected to a tab in the collar space in a connected position, and wherein the tab has a top tab portion that is sized to fit between the first side portion and second side portion of the shroud to prevent rotation of the collar on the shroud.

13. The cap of claim 10, wherein the collar is connected to a tab in the collar space in a connected position, and wherein the tab has a top tab portion that covers at least a portion of the actuator.

14. The cap of claim 1, wherein the collar has a collar wall having a collar hole through the collar wall and the shroud has a shroud hole through the shroud wall, and wherein the collar hole and the shroud hole are aligned in the open position.

15. The cap of claim 1, wherein the collar has a collar wall having a collar hole through the collar wall and the shroud has a shroud hole through the shroud wall, and wherein the collar wall covers the shroud hole in the closed position.

16. The cap of claim 15, wherein the collar wall contacts the shroud wall surrounding the shroud hole in the closed position.

17. The cap of claim 13, wherein the top tab portion covers 75 percent to 95 percent of the opening of the shroud.

18. The cap of claim 13, wherein the top tab portion has a depression and the depression and the shroud form a space therebetween that is accessible by a user's finger to apply a pressure to the tab for removal.

19. The cap of claim 1, wherein the collar has a top collar portion opposite a bottom edge, and wherein the top collar portion covers a portion of the contact portion in the closed position.

20. The cap of claim 18, wherein the top collar portion has a depression and the depression and the shroud form a space therebetween that is accessible by a user's finger to apply a pressure to the tab for removal.

21. The cap of claim 1, wherein the shroud wall has an outer surface that forms a depression with a post in the depression, and wherein the collar has an interior surface with a collar rib that protrudes from the interior surface that interacts with the post by creating a single pronounced clicking positional-indicating noise when the collar rib passes the post.

22. The cap of claim 1, wherein the cap deters in store spraying by users.

23. The cap of claim 1, wherein the cap prevents unintentional actuation by users.

* * * * *